US007101438B2

(12) United States Patent
Suzuki et al.

(10) Patent No.: US 7,101,438 B2
(45) Date of Patent: Sep. 5, 2006

(54) COATER FOR DISPERSED SLURRY

(75) Inventors: Migaku Suzuki, Tokyo (JP); Shingo Mori, Tokyo (JP)

(73) Assignee: Japan Absorbent Technology Institute, Tokyo (JP)

( * ) Notice: Subject to any disclaimer, the term of this patent is extended or adjusted under 35 U.S.C. 154(b) by 152 days.

(21) Appl. No.: 10/487,697

(22) PCT Filed: Aug. 26, 2002

(86) PCT No.: PCT/JP02/08558

§ 371 (c)(1),
(2), (4) Date: Feb. 25, 2004

(87) PCT Pub. No.: WO03/018210

PCT Pub. Date: Mar. 6, 2003

(65) Prior Publication Data

US 2004/0211361 A1 Oct. 28, 2004

(30) Foreign Application Priority Data

Aug. 27, 2001 (JP) ..... 2001-256454

(51) Int. Cl.
*B05C 1/08* (2006.01)

(52) U.S. Cl. ..... 118/249; 118/259; 118/106; 118/126; 118/414

(58) Field of Classification Search ..... 118/77, 118/414, 106, 126; 427/359
See application file for complete search history.

(56) References Cited

U.S. PATENT DOCUMENTS 771,998 A * 10/1904 Pick ..... 118/414
3,024,948 A * 3/1962 Rabl ..... 222/280
4,239,821 A * 12/1980 McLean et al. ..... 427/358
4,357,373 A * 11/1982 Cooper ..... 427/358
4,978,402 A * 12/1990 Hallworth ..... 156/77

FOREIGN PATENT DOCUMENTS

| | | | |
|---|---|---|---|
| JP | 5-41811 | Y2 | 10/1993 |
| JP | 7-299408 | A | 11/1995 |
| JP | 10168230 | A | 6/1998 |
| JP | 11-34200 | A | 2/1999 |
| JP | 11128825 | A | 5/1999 |
| JP | 11226467 | A | 8/1999 |
| JP | 2000-5674 | A | 1/2000 |

* cited by examiner

*Primary Examiner*—Laura Edwards
(74) *Attorney, Agent, or Firm*—Frommer Lawrence & Haug LLP; Ronald R. Santucci

(57) ABSTRACT

A coater for dispersed slurry capable of coating coated dispersed slurry on a nonwoven cloth-like base material while bringing the slurry into contact with the material, comprising a net conveyor for transferring the nonwoven cloth-like base material, a supply means for supplying the dispersed slurry onto the net conveyor, and a coating roll for forming a coating layer of a specified thickness by pressing, from the upper side thereof, the dispersed slurry supplied onto the nonwoven cloth-like base material, wherein this coating roll is allowed to come into direct contact with the dispersed slurry on the peripheral surface of the nonwoven cloth-like base material or allowed to come into contact with the dispersed slurry through a film provided therethrough.

16 Claims, 17 Drawing Sheets

(1) AT LONGER HEAD LENGTH (L) IMPREGNATION/FILTRATION ZONE PRIMARILY TAKES PLACE (2) AT RELATIVELY SHORT HEAD LENGTH (L) IMPREGNATION/FILTRATION ZONE AND SURFACE COATING ZONE TAKE PLACE (3) AT VERY SHORT HEAD LENGTH (L) SURFACE COATING ZONE PRIMARILY TAKES PLACE a: 3mm
b: < 0.5mm
c: 15mm
d: 12mm a: 15mm
b: 1mm
c: 15mm
d: 0mm a: 30mm
b: 3.7mm
c: 15mm
d: 15mm

COATER FOR DISPERSED SLURRY

This application is a 371 of PCT/JP02/08558 filed on Aug. 26, 2002, published on Mar. 6, 2003 under publication number WO 03/018210 A1 and claims priority benefits of Japanese Patent Application No. 2001-256454 filed Aug. 27, 2001.

TECHNICAL FIELDS

The present invention relates to a coater for coating a dispersion slurry, containing solid particles dispersed in a dispersion medium where the said solid dispersion slurry is dispersed to the surface of a substrate running continuously using a coating roll being made, and, more specifically, to an improved coater which in case the dispersion slurry tends to adhere the surface of the coating roll or a dispersion slurry where such solid particles as are likely to settle down, providing stable dispersion slurry that can be applied stably and uniformly to the continuously running substrate.

An example of said dispersion slurry is such as has super absorbent polymer (hereinafter called "SAP") dispersed in a medium and with such dispersion slurry being applied to a nonwoven fabric substrate, obtaining an absorbent sheet can be obtained.

BACKGROUND TECHNOLOGIES

With absorbent products being made super thin, such technologies as making SAP into a sheet form have become very important. Among such technologies, as a promising process, an attempt has been made to prepare a slurry by dispersing SAP in water, an organic solvent or an organic solvent/water mixed solvent using a viscosity adjusting agent such as CMC, MFC and PEO for coating a support. For example, in Patent Application Laid-open Hei 10-168230, an example where a coater and a kiss coater of a grid form, in Patent Application Laid-open Hei 11-34200, an example where coating is conducted from a nozzle of a tube type, in Patent Application Laid-open Hei 11-128825, an example where a die coater, a curtain coater, a knife coater or a spray coater is used, in Patent Application Laid open Hei 11-226467, an example where a slurry is guided from a buffer tank through to an overflow nozzle and in Japanese Patent Application Laid-open 2000-5674, an example where a pattern coating is conducted using a contact head are disclosed respectively.

In coating various types of substrate surfaces, the dispersion slurry in which solid particles are dispersed in a dispersion medium, unlike the case where a liquid to be applied for coating is a uniform solvent, is apt to have some partial variation in concentration due to phase separation, settling down, agglomeration and the like. In case the dispersion slurry is applied for coating, it is preferable to utilize a low cost roll coater of a relatively simple structure among various coaters available, but with such roll coater dispersed solid particles are apt to settle down in the dispersion slurry or to adhere to the surface of a coating roll. If such settling down or adhesion takes place, the coated surface may be uneven or clogging may take place during operation so that it becomes difficult to run a uniform and stable coating operation.

In order to diminish the settling down and adhesion of the dispersed solid particles, such actions for establishing making a condition where slurry may be made easier to be detached have been taken like treating of the surface of a coating roll with a material such as silicone and Teflon (registered trademark), scraping by means of a scraper, and rotating of a roll in a positive direction or a reverse direction.

Compared with such solid containing dispersion slurry, since the slurry in which SAP is dispersed is less fluid and thus apt to get of sludge like, it becomes more difficult to obtain stable and uniform coating with such SAP dispersion slurry and so far no commercial process therefor has been developed yet.

DISCLOSURE OF THE INVENTION

The objective of the present invention is to provide a coater enabling a SAP dispersion slurry to be coated uniformly both in a width direction and in a length direction at a wide range of speeds not causing any clogging over a wide range of basis weights.

A coater according to the present invention is provided with a apparatus for continuously running a nonwoven fabric substrate in a horizontal direction, a head bath whose top is opened, located over said running nonwoven fabric substrate and forming a bath for holding said dispersion slurry on the top surface of said nonwoven fabric substrate, a liquid seal plate for so sealing that said dispersion slurry may not leak from underneath of said nonwoven fabric substrate, and a coating roll rotating in a positive direction with respect to the running direction of said nonwoven fabric substrate, wherein said coating roll is so structured that a pressing pressure is exerted against said nonwoven fabric substrate and the dispersion slurry as coated onto the surface of said nonwoven fabric substrate while the surface coated with said dispersion slurry is made smooth.

A coater of a preferred form according to the present invention is provided further with a cover film provided as covering the peripheral surface of said coating roll in a range from the position of the topmost end vicinity of said coating roll extending through to the position of the bottom end vicinity thereof so that said dispersion slurry may be supplied between the top end of said cover film and the surface of said substrate.

A coater according to the present invention may be disposed in a position facing with said nonwoven fabric substrate as sandwiched between its top and bottom with said coating roll and provided with a support roll rotating in a positive direction with respect to the running direction of said nonwoven fabric substrate.

The top end portion of said cover film need not be fixed or said cover film except its top end portion may be so fixed by a side seal that said cover film is held in a prescribed position along the peripheral surface of said coating roll in both end portions in an axis direction of said coating roll.

Said cover film may be constituted by a laminated film made by overlapping 2 sheets of film whose physical properties are different from each other.

Out of these two sheets of film, a first film extends preferably up to a position extending over said side seal and is fixed at said side seal, and a second film has preferably a width covering only the inner side of said side seal.

Said first film may be disposed in a position facing said coating roll, and said second film may be disposed in a position outside of said first film.

Alternately, said second film may be disposed in a position facing said coating roll, and said first film may be disposed in a position outside of said second film.

Said first film may be shorter than said second film with respect to the running direction of said substrate.

Said first and second films may be bonded to each other at least in parts.

Said first film is preferably a 50 μm or thicker PET film, and said second film is constituted by a 50 μm or thinner PET film.

The top end portion of said cover film may extend from the bottom end of the peripheral surface of said coating roll in its downstream side over a desired distance with respect to the running direction of said nonwoven fabric substrate.

On the other hand, with respect to said coating roll, it has preferably a diameter in a range of 100~500 mm and the end portion of said cover film extends preferably only over a range of 1~50 mm from said bottom end position down to its downstream side with respect to the running direction of said nonwoven fabric substrate.

It may be preferable to prevent the top end portion of said cover film from getting into contact with the peripheral surface of said coating roll, and a separator may be provided for that purpose.

In order to form a coating pattern on the surface of said nonwoven fabric substrate, a pattern spacer is further provided, thereby said dispersion slurry going from the top end portion of said cover film to its downstream that is to be supplied to the surface of said nonwoven fabric substrate is so regulated that the slurry is not supplied onto the surface of said substrate and thus a desired coating pattern may be formed.

Said coating roll surface may have some parts that are concave and convex, causing the areas in parts where the surface of said coating roll and said cover film do not get into contact to be provided so that any excessive contact friction between the two may be prevented from taking place.

Said dispersion slurry may contain as a solid component particulate, powdery or flaky SAP, and a preferable dispersion medium in such case is a mixture solvent of an organic solvent and water.

Said SAP may be particles having a diameter of 1000 μm or less, and said dispersion medium may be a mixture of water and a solvent of an organic solvent having a function of inhibiting swelling and water.

Said substrate may be of any nonwoven fabric, and may be a porous nonwoven fabric.

According to the present invention as explained above, during coating using dispersion slurry, a uniform thickness both in a width direction and a length direction, a wide range of speeds can be achieved with no clogging of the dispersion slurry taking place in coating nonwoven fabrics over a wide range of basis weights. Thus, the resulting coating film is uniform in thickness and smooth on the surface.

Furthermore, in case a cover film is applied, a problem common to any contact type coater such as a bar coater and a knife edge coater that is a substrate may get in contact with a coater, i.e. dispersion slurry may adhere to the surface of a coating roll, can be solved without any complicated coating equipment and resulting considerably increased costs involved. In particular, for any case where water absorbent solid particles of high surface adherence are applied as in case where a dispersion slurry which is made by dispersing absorbent solid particles in a dispersion medium of a water/organic solvent type, uniform and stable coating may be realized.

BRIEF DESCRIPTION OF DRAWINGS

FIG. 5A is its side view and FIG. 5B is its plane view.

FIG. 7A is its side view, and FIG. 7B is its plane view.

FIG. 8A is its side view, and FIG. 8B is its plane view.

FIG. 11A is its cross sectional view, and FIG. 11B is its elevational view.

FIG. 12A is it's cross sectional view, and FIG. 12B is its elevational view.

BEST MODE OF PRACTICING THE PRESENT INVENTION

Figure 1:
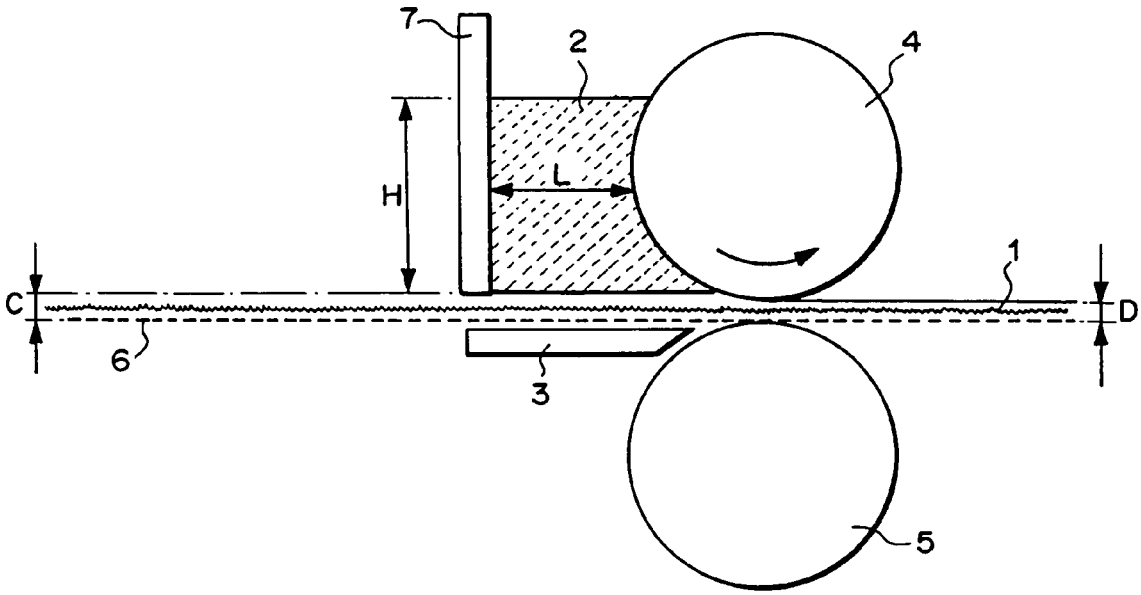
FIG. 1 shows a basic structure of a coater according to the present invention.

In the following, preferred embodiments of the present invention are explained with reference to the drawings:

Prior to making such explanation, it will be necessary to understand the characteristics of SAP and SAP dispersion slurry and of a nonwoven fabric substrate.

Coating of an even film or metal foil with slurry of high viscosity and high fluidity is already industrially established technology, and such technology is classified into an extrusion method such as die coating, curtain coating and nozzle coating and a head flowing method provided with a head bath. Coating heads such as a lip direct head, a comma direct head, a comma reverse head, a bottom feed reverse roll head, a direct gravure head, a kiss coating head, a squeeze coating head depending on the applications have been proposed.

It is extremely difficult, however, to achieve a stable and uniform coating by applying any such conventional coater in a process of coating a nonwoven fabric substrate having rough surface with SAP slurry.

(1) Characteristics of SAP and SAP Dispersion Slurry

SAP provides a spherical shape and a flaky shape depending upon the polymerization methods applied. If SAP of both shapes is measured in terms of approximated particles, the diameter of SAP has a wide distribution of 30~1000 μm, and SAP is very irregular in shape and bulky. Also, SAP is naturally extremely sensitive to water.

SAP is apt to self coagulate if an attempt is made to disperse it into a slurry form (Japan Tappi Journal: 1079, Vol.52, No.8 (1998)), and it is extremely unstable, but it may be made into slurry in an organic solvent/water mixture. As it is, however, since it instantaneously settles down even if it is agitated, it is made stable by using a viscosity adjusting agent or a bonding agent. In conclusion, at this moment, it is most preferable condition to have SAP in coexistence with MFC (microfibrillated cellulose).

Thus, even such stabilized slurry is likely to settle down unlike one normally available in industrial applications, and because of its poor fluidity, it easily becomes sandy or sludge-like, so that it needs to be continuously agitated in dispersion medium.

(2) Characteristics of Nonwoven Fabric Substrate

A nonwoven fabric substrate to be used in the present invention is preferably a porous and has a structure where solids in slurry are supported and a dispersion medium is easily permeated, such as a spun bonded nonwoven, a spun bonded/melt blown composite nonwoven, a spun laced nonwoven, a thermal bonded nonwoven, an airlaid matte, a crepe paper, a pile fabric and a towel fabric.

More preferable nonwoven fabric substrates are bulky and capable of supporting SAP in its structure. As described later, an example of such more preferable nonwoven fabric substrates is a nonwoven fabric made by overlapping a carded web onto a crepe paper and entangling both of them in parts resulting in a fluffy nonwoven fabric substrate with the resulting weight being approximately 20 g/m$^2$ and thickness being approximately 1.5 mm, as obtained in FIG. 9. If an attempt is made to coat such substrate by means of a conventional coater, such substrate undergoes considerable variation in thickness so that a resultant product becomes very uneven in weight distribution.

(3) Comparison Between Coating Directly Nonwoven Fabric in a Dry State and Coating Nonwoven Fabric Saturated with a Dispersion Medium Table 1 shows two examples of coating a nonwoven fabric in a dry state and a nonwoven fabric with its voids filled with a dispersion medium for understanding the characteristics of SAP and a nonwoven fabric.

For these experiments the following substrate and SAP dispersion slurry were prepared:

TABLE 1

| Details of substrate and dispersion slurry | | |
|---|---|---|
| | Nonwoven fabric substrate <Spun bonded/carded web composite sheet> | |
| Spun bonded: | 12 g/m$^2$(from Avgol) | |
| Carded web: | PET Staple Fiber (6 d × 51 mm), 25 g/m$^2$ From Teijin | |
| Thickness: | 2 mm | |

TABLE 1-continued

| Details of substrate and dispersion slurry | | |
|---|---|---|
| | Conditions of slurry | |
| SAP: | Aqua Pearl (particle average diameter 500 mm) From Mitsubishi | |
| | Chemical | |
| Dispersion medium: | Ethanol/water = 70/30 | |
| Composition of slurry: | SAP | 20% |
| | MFC | 0.5% |
| | Dispersion medium | 75% |

Figure 5A:
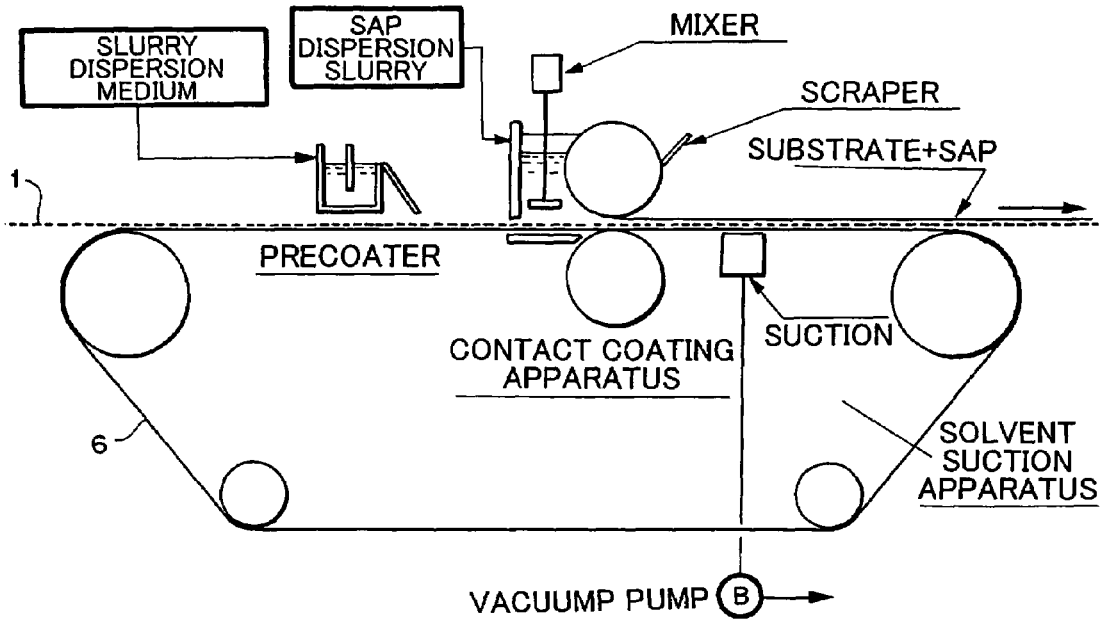
FIGS. 5A~5B are illustrations showing a typical coating system according to the present invention.
Figure 5B:
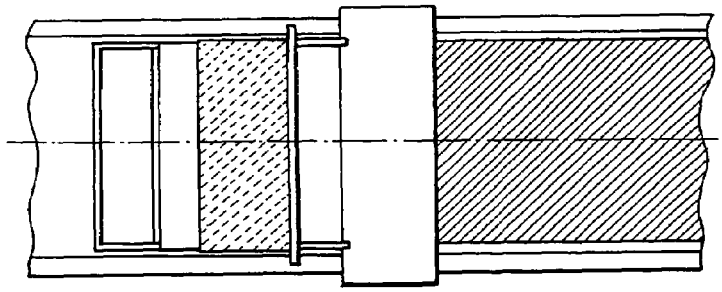

Coating was performed in a process shown in FIGS. 5A~5B. The clearance of a coater installed was fixed at 1.5 mm on the inlet side upstream and varied between 1.0~1.6 mm on the outlet side downstream, and the coating was done at 20 m/min. For a web in a dry state, coating was applied directly to it as it is, and for a saturated web, first a quantity of a dispersion medium of ethyl alcohol/water=70/30 was added to the web sufficient to make its weight 200% of the original weight in a precoat area, and then coating was applied.

Table 2 shows the test results. In case coating was applied directly to a nonwoven fabric substrate in a dry state, the basis weight of SAP was nearly 300 g/m$^2$, and there was almost no change in weight even when the clearance was changed. This weight was nearly comparable to the quantity of the dry web obtained when the web was first impregnated with the SAP dispersion medium and then the dispersion medium was removed with the web used as a filter. Meantime, in the case of the nonwoven fabric substrate saturated initially with the dispersion medium, the basis weight was proportionate to the clearance.

TABLE 2

| | Coating conditions | | | |
|---|---|---|---|---|
| | Clearance | | | |
| State of substrate | 1.0 mm | 1.2 mm | 1.4 mm | 1.6 mm |
| Dry | Clogged | 290 g/m$^2$ | 298 g/m$^2$ | 302 g/m$^2$ |
| Saturated with dispersion medium | 80 g/m$^2$ | 110 g/m$^2$ | 150 g/m$^2$ | 200 g/m$^2$ |

The present invention proposes, as shown in Table 2 above, an apparatus and a method for four different conditions such as stated of ① coating being done to a substrate in a dry state, ② coating being done to a substrate after it is saturated with a dispersion medium, ③ the effect of the substrate as a filter being utilized, and ④ emphasis being placed on the surface coating process by means of a coating roll with these four condition are combined in a very ingenious way.

The present invention will be explained in detail with reference to the drawings.

〈Basic Structure of Coater According to the Present Invention〉

FIG. 1 shows a basic structure of a contact coater according to the present invention.

This coater comprises rear gate 7 disposed having an appropriate rear gate clearance (C) on a net conveyor 6 for transferring a nonwoven fabric substrate 1, coating roll 4, support roll 5 disposed at a position facing the coating roll via the net conveyor, and nose plate 3 provided on the downside of the net conveyor 6 for sealing the bottom of head bath 2 formed on the upside of the nonwoven fabric substrate 1 between the rear gate 7 and the coating roll 4.

The head bath 2 is formed between the rear gate 7 and the coating roll 4. The head bath 2 provides a space for storing a slurry liquid at a first stage. The volume of the head bath 2 is determined by its longitudinal distance (hereinafter called "head length (L)") if the width of the nonwoven fabric substrate 1 is given, and the quantity of the slurry stored in the head bath 2 is determined by the height of the head bath (H). This stored quantity is appropriately controlled depending upon such conditions as the desired basis weight and the running speed of the nonwoven fabric substrate 1.

In the coating job, the clearance (C) of the rear gate is adjusted by raising or lowering the rear gate 7 depending upon the apparent thickness (that is to say, bulkiness) of the used nonwoven fabric substrate. Generally speaking, the clearance should be set somewhat smaller than the bulkiness of the nonwoven fabric substrate 1. For example, the clearance is adjusted at approximately 3 mm for the bulkiness of 4 mm of web. The rear gate clearance (C) does not depend upon the running speeds, basis weights, etc. The clearance (D) is a very important controlling element and is finely adjusted depending upon such conditions as the basis weights, the properties of the substrate, its running speed and the coating patterns with respect to the height (H) of the head bath 2. The range of variation, however, is in a range of approximately 1.0~2.0 mm. The position of the support roll is fixed and by raising or lowering the coating roll 4 with its distance to the support roll 5, the clearance (D) is adjusted and measured.

The nose plate 3 serves for sealing the bottom surface of the head bath 2 via the net conveyor 6, and, on the upstream side, covers the distance from the position of the rear gate 7 or its upsteam down to a position nearing to the support roll 5. On the downstream side, the top end of the nose plate 3 is made thin so that it may get near to the support roll 5 as much as possible and more easily seal the bottom surface of the support roll 5. Note that both edges of the nose plate 3 in the width direction are to preferably coupled and sealed to a side seal (not shown).

The coating roll 4 rotates in a positive direction with respect to the running direction of the nonwoven fabric substrate 1, and thus serves to push out the SAP slurry which otherwise is apt to get clogged.

In a conventional coater, in order to improve the metering accuracy, generally speaking, a coating roll is fixed as in the case of a comma coater, or is reverse rotated as in the case of a reverse coater. As against this conventional approach, in the present invention the coating roll 4 is made to rotate in a positive direction, and thus to push out the SAP dispersion slurry in a positive manner. The rotating speed of the coating roll 4 is changed from 0~200% depending upon the conditions based on the running speed of the substrate being 100. Normally, the rotating speed is preferably adjusted in a range of 100% ±20%.

Another function of the coating roll 4 is to force the SAP slurry into the voids within the fibrous network of the nonwoven fabric substrate 1 and to make the surface of the coating smooth by regulating the coating thickness of the slurry. In a conventional method, since this part is a fixed edge, if small blocks of SAP are mixed even in a very small quantity, a coating roll may easily be clogged, and if such clogging takes place, the coated surface may be made fluffy resulting in a poor product quality and also in causing the surface of a drying roll in a drying step to get stained. In this sense, by rotating the coating roll 4, i.e. an outlet roll, the SAP dispersion slurry may be smoothly pushed out and at the same time getting a smooth, coated surface.

For the above-mentioned reasons, the structure of the coating roll 4 is preferably such that the surface is of a mirror finish, and yet for reducing adhesion to the surface the coating roll 4 may advantageously utilize polytetrafluoroethylene [Teflon (registered trademark)] coating, silicone coating, or a pearskin finish. In addition, in order to remove stain from the surface of the coating roll 4 or to prevent the substrate from being wound up by the surface of the coating roll 4, a scraper may be provided.

Figure 2:
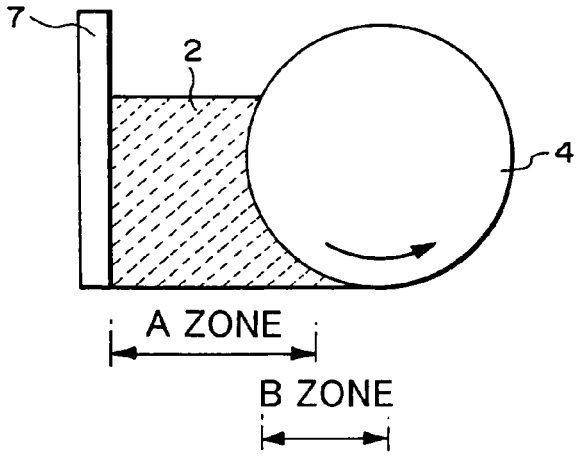
FIG. 2 shows illustratively a process of forming a sheet supporting SAP from SAP dispersion slurry as supplied to a head bath.

FIG. 2 is an illustration showing a process of from the SAP dispersed slurry supplied to the head bath 2 to formation of a SAP supported sheet.

In a system of a film or a metal foil where no slurry permeates a substrate, the coated quantity on a substrate is primarily regulated by the clearance (D), but in a nonwoven fabric substrate, in particular in a bulky substrate preferable in the present invention, first of all, the actions of impregnating into the network of a substrate and of filtering by means of the substrate take place at the same time, and at approximately the same time when the SAP dispersion slurry is supported into by the substrate, depending upon the clearance a slurry layer coated on the surface is formed. FIG. 2 shows the positional relation between A zone where SAP is supported primarily by the actions of such impregnation and filtration (impregnation and filtration zone) and B zone where the surface is coated (surface coat zone). These zones overlapped with each other, and cannot be clearly separated, and thus they are shown in FIG. 2 to be overlapped in parts.

Figure 3A:
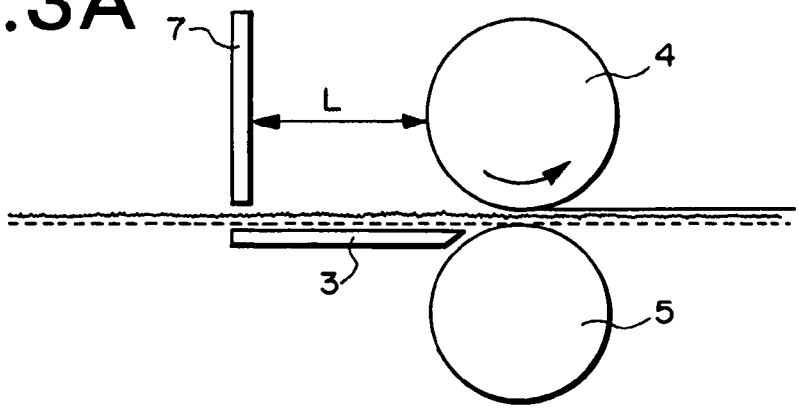
FIGS. 3A~3C are illustrations showing the effects of the head length (L) of a head bath.
Figure 3B:
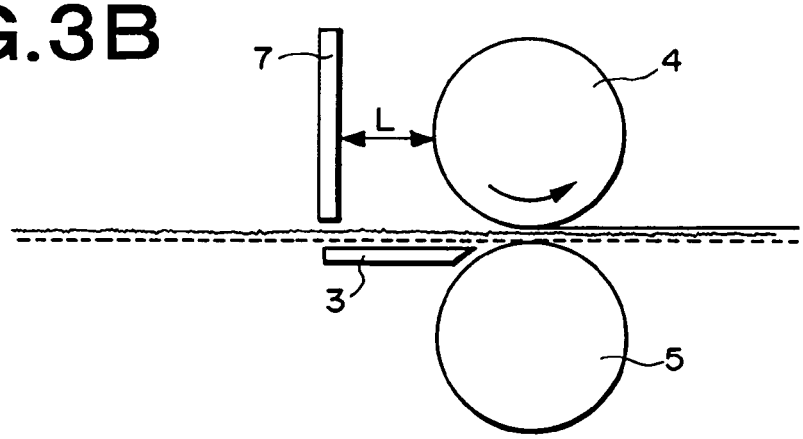
Figure 3C:
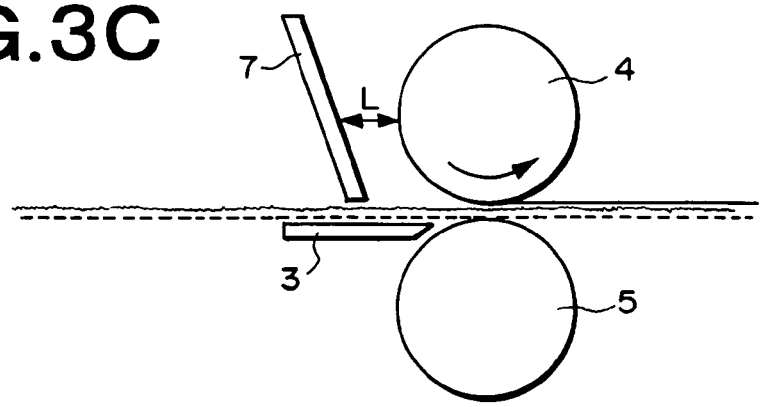

Which of these two zones plays a primary role is very much dependent upon such conditions as the properties of the substrates, coating speeds, and shapes of the head bath. FIG. 3A~3B show how the head length (L) of the head bath 4 affects the coating state. As shown in FIG. 3A, if the head length (L) is made longer, the formation of the SAP supported layer takes place primarily in the impregnation and filtration zone (A zone), while if the head length (L) is made shorter, as shown in FIG. 3B, such SAP supported layer is formed with A and B zones combined alternately, and if the head length (L) is made still shorter, the SAP supported layer is formed primarily in the surface coat zone (B zone). If the head length (L) is desired to be further shorter, as shown in FIG. 3C, the rear gate 7 should be inclined as its bottom end is displaced to the downstream side.

Figure 4A:
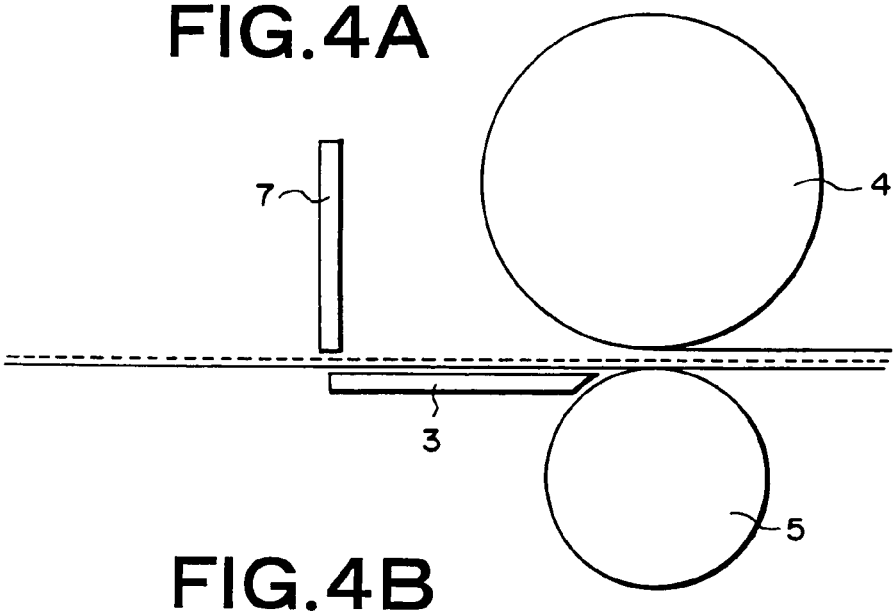
FIGS. 4A~4C are illustrations showing the configuration of a coating roll and a support roll.
Figure 4B:
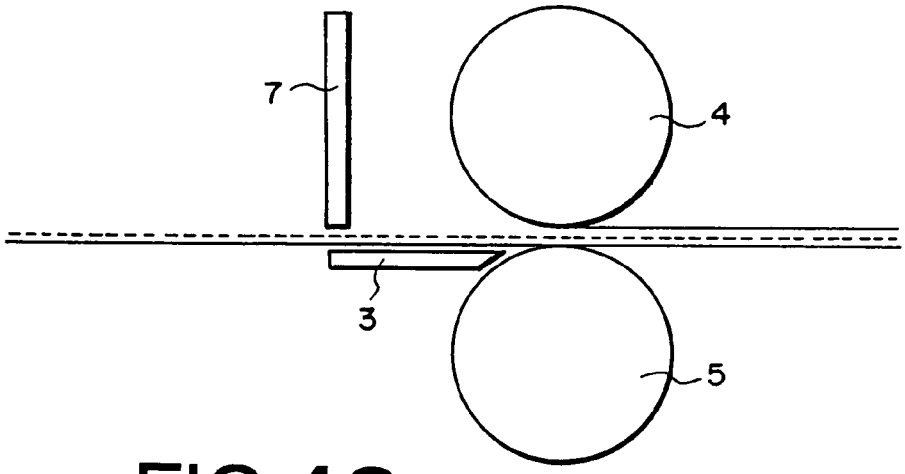
Figure 4C:
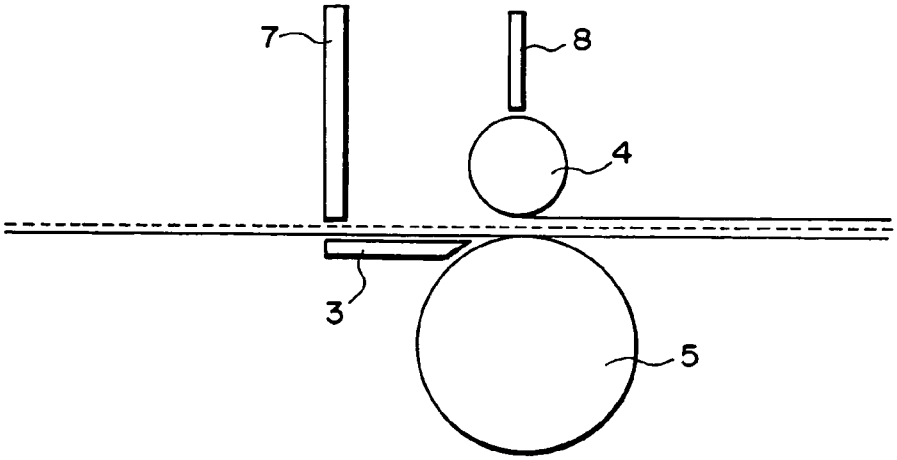

FIGS. 4A~4C show the arrangement of the coating roll and the support roll as disposed.

FIG. 4A is an example where the diameter of the coating roll 4 is made large as against the diameter of the support roll 5, so that a zone for forming a coating layer in the head bath 2 is made wide. This example is suitable to an operation at relatively high speeds, and well matches the condition that the peripheral speed of the coating roll 4 is higher than that of the moving speed of the substrate 1.

FIG. 4B shows an extremely general case where the diameter of the coating roll 4 is made approximately the same as that of the support roll 5.

FIG. 4C shows an example where the diameter of the coating roll 4 is made smaller than that of the support roll 5 and a front gate 8 is provided for securing a space of the head bath 2. This example, in contrast to the example shown in FIG. 4A, is suitable to the case where the coating roll 4 is made to rotate at relatively low speeds.

⟨Coating System With the Coater Incorporated⟩

In the foregoing, a basic structure of the coater has been explained, but, in order to form a coating system, other important units such as a precoater unit and a solvent suction apparatus are required to be incorporated.

FIGS. 5A~5B show the configuration of a typical coating system according to the present invention. Viewed in the forward direction of the substrate, a precoater, a coater, and a solvent suction apparatus are arranged in this order. The precoater has the following three functions:

Firstly, in case a nonwoven fabric substrate 1 is bulky and for example a hairy web, such step that coating the substrate beforehand, the voids in the substrate are filled with a dispersion medium and then coating is done by applying a slurry, so that a uniform coating may be realized on the substrate in the same way as for tissue and a spun bonded nonwoven fabric having a relatively thin and smooth surface.

Secondly, the precoater functions to make the substrate as a whole, i.e. from its inside structure to its surface, smooth by making microscopic roughness on the surface of the substrate even or by replacing air contained inside the substrate with a solvent.

Thirdly, by getting the conveyor 6 and the substrate 1 into close contact with each other and thus integrating both of them, it will be possible to secure a uniform contact-by-pressure state on the coater.

In case a relatively thin, uniform and nonbulky nonwoven fabric such as tissue and spun bonded web is used, the first function of the precoat, i.e. filling of voids, is not very important, but the second and the third functions are important.

In the present invention, therefore, although the quantity of the dispersion medium to be precoated depends upon the characteristics of the substrate, it is preferable to always apply the precoat for any type of the substrates. As methods of applying precoats, a spraying and a contact transferring are available, but since the hairy state or the bulkiness may change by getting in contact with the roll, it is preferable to employ an overflow type precoat as shown in FIGS. 5A~5B. In adding the dispersing medium in the precoat, it is not necessary to saturate 100% of voids of the substrate, but it is sufficient to saturate approximately 50% of the voids.

Agitating of the slurry in the head bath 2 is particularly important for the slurries that are apt to settle down and thus become sludge-like such as the SAP dispersion slurry used in the present invention, and in case the flow rate should be lowered, such slurries immediately settle down and deposit, thus a careful attention is needed.

A scraper is not indispensable, but if prevention of staining or of wrapping up is needed, the scraper is preferably provided. A solvent suction solvent suction apparatus is important in the sense that by such operation, SAP and the nonwoven fabric substrate are made in an integrated form and at the same time the load on the subsequent drying step can be lowered. The solvent suction apparatus is provided by disposing a suction box underneath the net conveyor. By the vacuum pressure of the suction box, almost all of the liquid dispersion medium contained in the SAP dispersion slurry is removed, and any residual solvent and water are removed in the following drying step, so that a SAP sheet in a dry state can be obtained.

This solvent suction solvent suction apparatus may be one unit if the production speed is slow and that a full width coating is done, but in the case of a pattern coating or in a higher speed operation even with the full width coating, it may be necessary to install two sets of such solvent suction apparatus.

Figure 6:
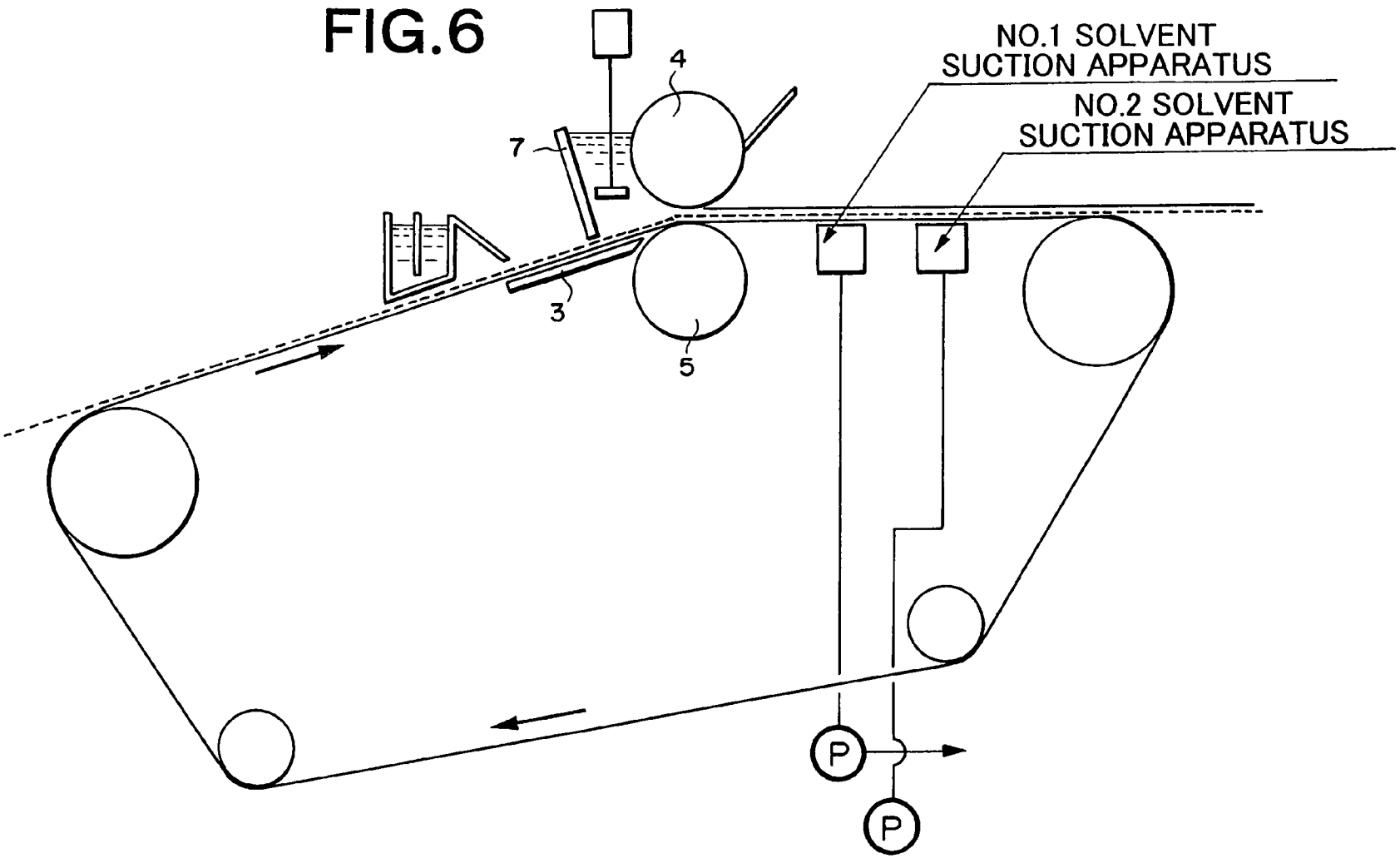
FIG. 6 shows a first and a second solvent suction apparatus positioned in the downstream of a coater.

FIG. 6 shows the configuration of a coating system where a first solvent suction apparatus and a second solvent suction apparatus solvent suction apparatus are provided on the downstream side of the coater. Note that in this coating system the conveyor is disposed as inclined so that the clearance can be more easily adjusted.

Now, turning back to the solvent suction apparatus solvent suction apparatus, in installing the first and the second solvent suction apparatus solvent suction apparatus, it is preferable to set the vacuum pressure higher and the air flow lower for the first solvent suction apparatus solvent suction apparatus than for the second solvent suction apparatus solvent suction apparatus. As the first vacuum pump for suction, such pumps that can keep the vacuum relatively high like a Nash roots pump and a root pump are employed preferably, and as the second vacuum pump for suction, such pumps that can keep the vacuum relatively low, but the air flow relatively high like a turbo blower are employed preferably.

To show an example of the specific performance of an solvent suction apparatus solvent suction apparatus, this apparatus is constituted by a first suction zone and a second suction zone, and the vacuum pressure of the first suction zone is kept at 26.6 kPa~53.2 kPa (200 mmHg~400 mmHg) and the vacuum pressure of the second suction zone at 6.65 kPa~33.3 kPa (50 mm Hg~250 mm Hg), and thus the vacuum pressure of the first suction zone is kept higher than that of the second suction zone.

<Changing of Coating Patterns>

In case the whole area of a substrate is coated uniformly, the coating with the SAP slurry can be done using such coater as has been described in the foregoing. In case coating of patterns in lines or patterns in horizontal stripes or patterns with thick and thin areas provided is desired, some or other scheme is required.

Figure 7A:
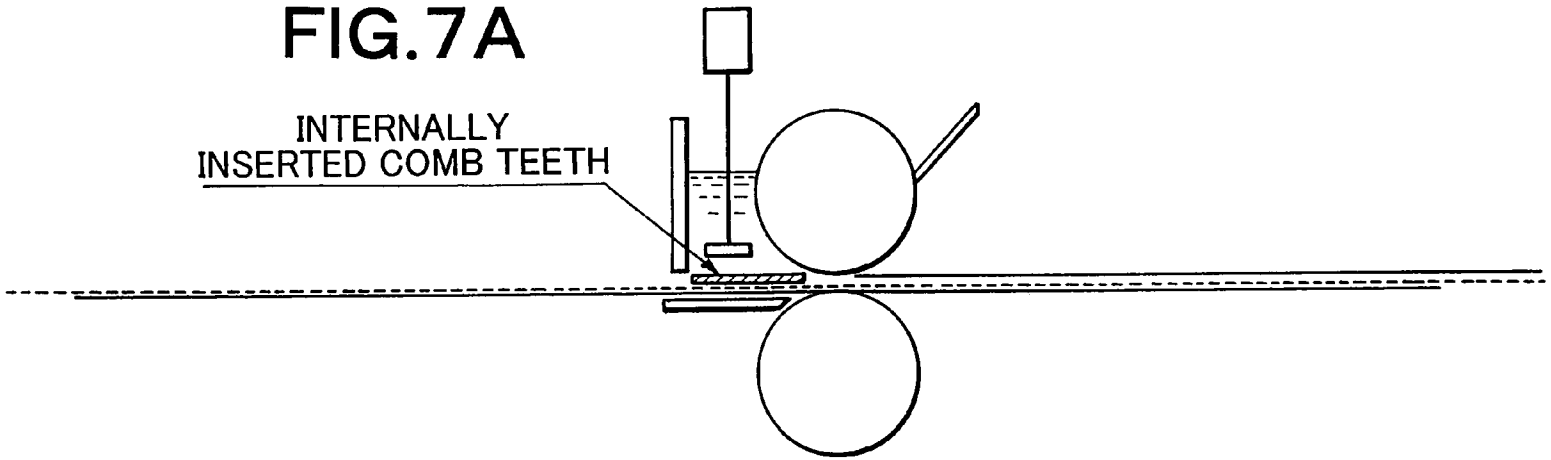
FIGS. 7A~7B show an example of comb teeth being inserted interpolatively.
Figure 7B:
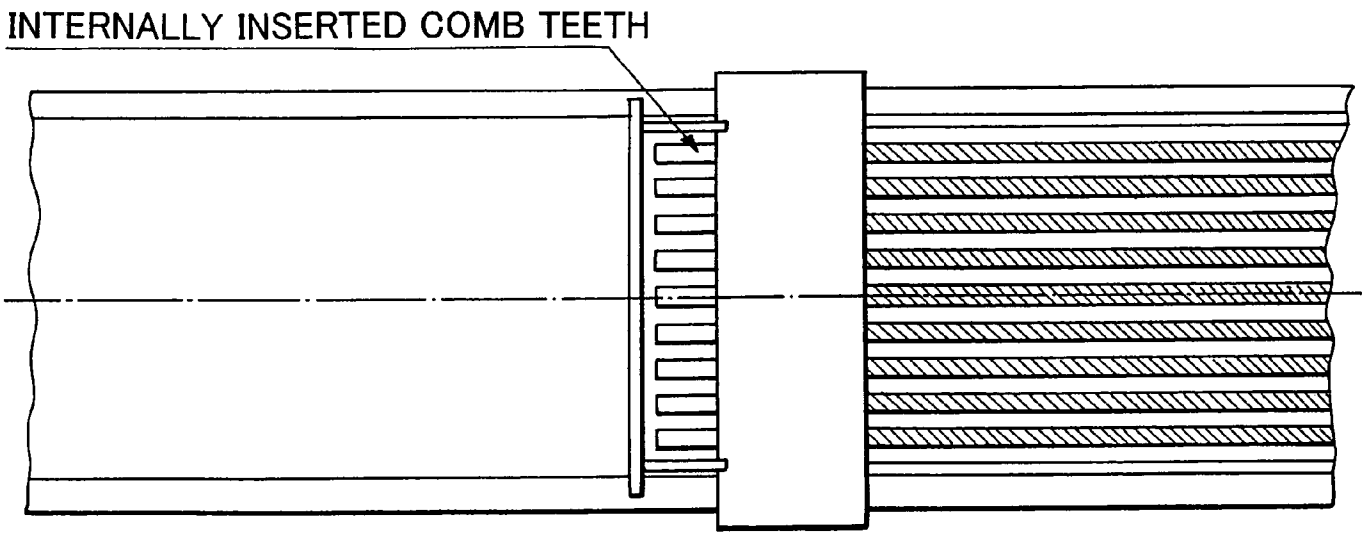
Figure 8A:
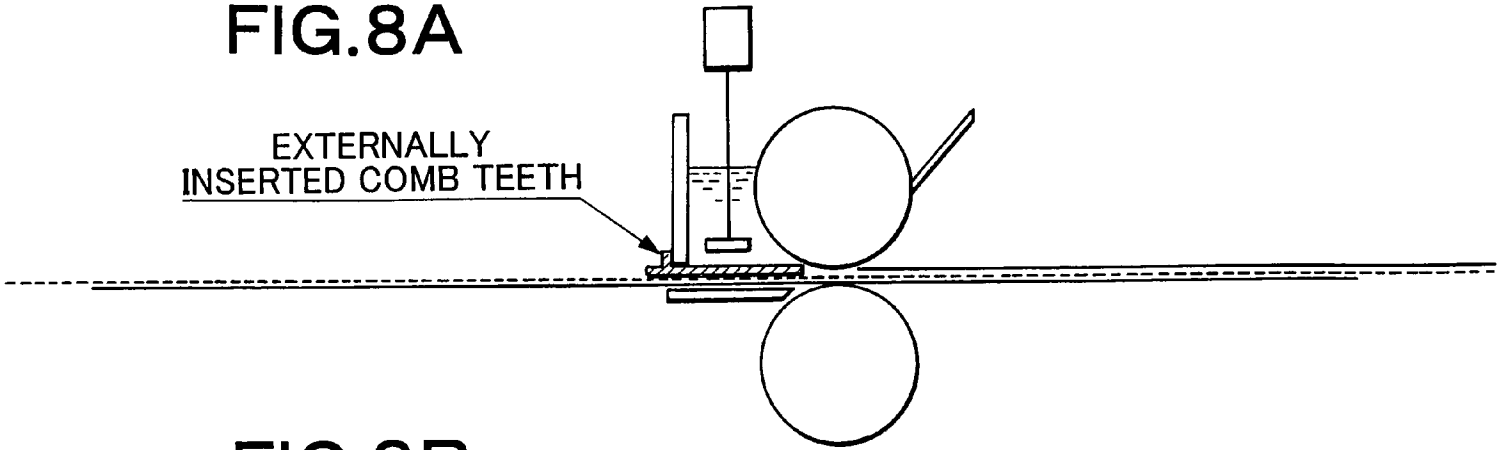
FIGS. 8A~8B show an example of comb teeth being inserted extrapolatively.
Figure 8B:
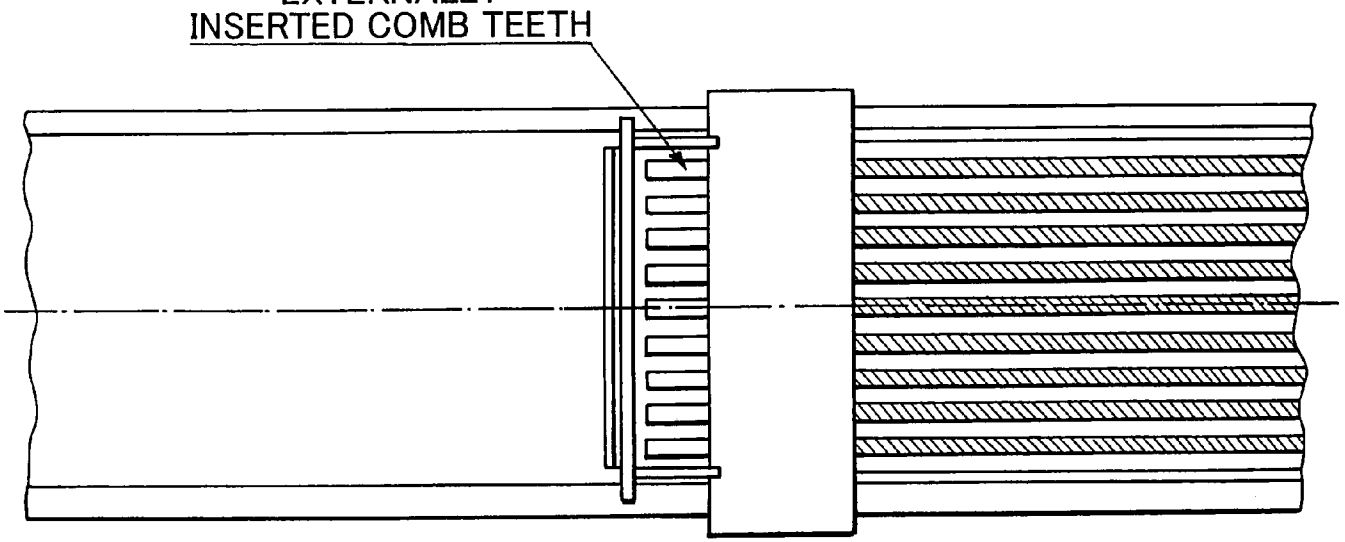

Generally speaking, as proposed by the inventors of the present invention in Patent Application Laid-open 2000-5674, a method of inserting a comb is simple and easy to apply. In this case, as shown in FIGS. 7A~7B, such a comb is inserted interpolatively, and as shown in FIGS. 8A~8B, such a comb is inserted extrapolatively. Either of them can be selected. In the cases of FIGS. 7A~7B and FIGS. 8A~8B, the areas where SAP exists and the areas where no SAP exists are clearly sectioned in bands. In case patterns having thick & thin layers of SAP are formed, such forming of patterns at the last stage of coating can be achieved by using a coating roll on the surface of which vertical grooves or lateral grooves are formed.

<Manufacturing Process of SAP Sheet with the Coater Incorporated>

Figure 9:
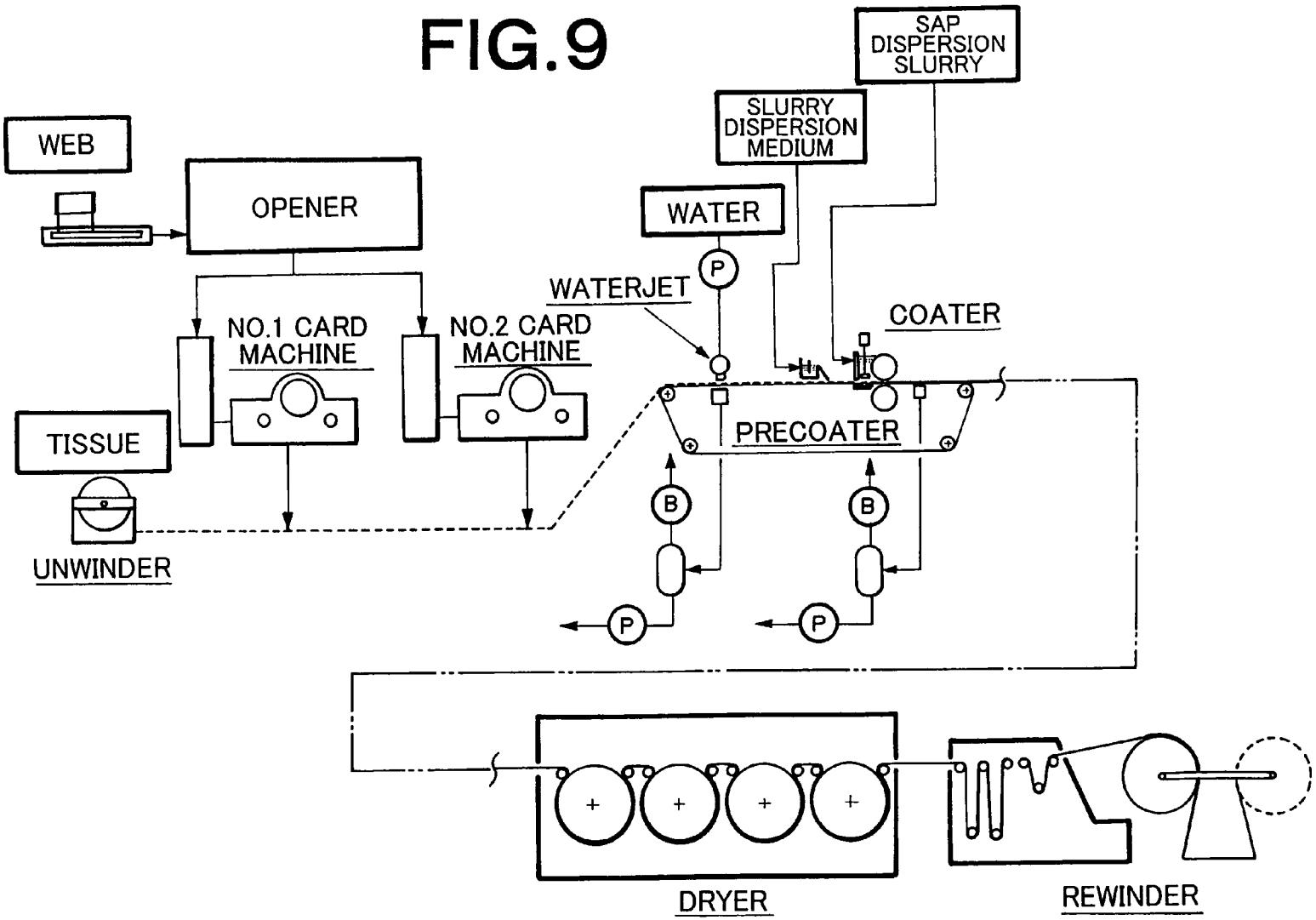
FIG. 9 shows the whole flow of a process of manufacturing a composite material of tissue and carded web, coating with SAP dispersion slurry while the composite material is bonded and entangled in a high pressure water entangling apparatus, removing the solvent and drying.

A process of manufacturing a SAP sheet with a coater according to the present invention incorporated will be explained below. FIG. 9 shows the whole flow of such process consisting of manufacturing of a composite substrate of tissue and a carded web, coating with a SAP dispersion slurry while such substrate is entangled and bonded in a high pressure water stream apparatus, removing the solvent by suction and drying. In other words, this flow consists of the following unit processes:

1. Step of preparing a non-bonded carded web;
2. Step of transferring the web onto a net conveyor;

3. Step of stream entangling said web at water beam intervals of at least 5 mm or more on said net conveyor by means of a high pressure water of 2.06 mPa (20 kg/cm$^2$) or more;

4. Step of saturating said water stream entangled web with a SAP dispersing medium comprising an organic solvent/water mixed solvent by means of a precoater;

5. Step of coating said web saturated with said dispersing medium with said SAP dispersion slurry prepared of said organic solvent/water mixed solvent as a dispersing medium;

6. Step of removing by suction the solvent from said SAP coated web obtained by said coating; and 7. Step of thermally drying in a dryer said SAP coated web from which the solvent is removed.

<Basic Structure of Coater According to the Present Invention with a Cover Film Applied>

Figure 10:
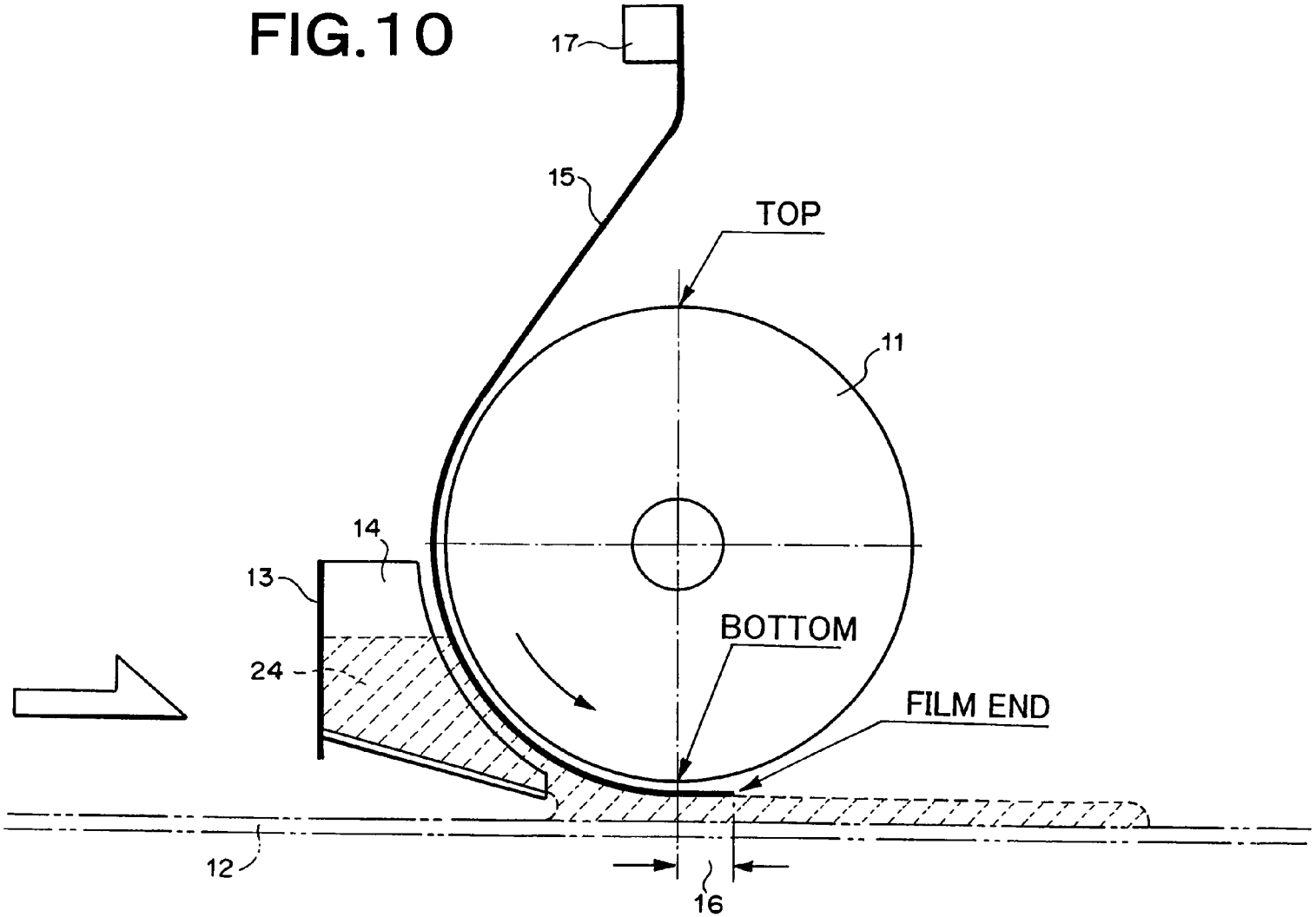
FIG. 10 is a cross sectional view showing an embodiment of a coater according to the present invention with a cover film applied.

The coater and the process with such coater incorporated of the present invention have been explained. There is a means available for covering the surface of a coater with a film in order to fundamentally solve adhering of solids on the coating roll. Such means is explained in detail below:

FIG. 10 shows an example of a coater according to the present invention with a cover film applied. A coating roll 11 disposed with its axis center being made horizontal and made to rotate at a desired speed at its with the axis center, and underneath of the coating roll 11 a substrate 12 is made to run by means of a certain apparatus (not shown) continually in a tangent direction to the peripheral surface of the coating roll which is moving at a position in the vicinity of the bottom end of the peripheral surface in the rotating course of the coating roll 11.

In addition, a dispersion slurry 24 to be coated on the surface of the substrate 12 is made to continually supplied to the surface of the substrate 12 at a discharge position determined near the downstream from a position in the vicinity of the bottom end of the peripheral surface of said coating roll with respect to the running direction of said substrate through a slurry storage 14 provided as necessary in the rotating cycle of the coating roll 11.

Furthermore, a cover film 15 is disposed so that the dispersion slurry 24 to be supplied from the slurry storage slurry storage 14 may cover the coating roll 11 not getting into contact with the peripheral surface of the coating roll 11 and its end is made to pass over the bottom end of the coating roll 11. The dispersion slurry is made to be supplied to the space between the end of this cover film 15 and the surface of the substrate 12, and this space provides a discharge position of the dispersion slurry.

In example shown in FIG. 10 the cover film 15 is, at its top end, fixed to a prescribed position by means of a film fixing member 17, and its other end has a length extending to the bottom end of the coating roll 11 reaching a position toward the downstream side with respect to the running direction of the substrate 12, and this other end is so constituted that it is sandwiched between the coating roll 11 and the substrate 12.

The coater of the dispersion slurry as such constituted will be explained in terms of its components below:

First of all, the coating roll 11 has a clearance (a gap) formed of a prescribed distance from the surface of the substrate 12 running continually underneath of the coating roll at the bottom end of the peripheral surface thereof, and by means of this clearance the thickness of the dispersion slurry 24 to be coated on the surface of the substrate 12 can be regulated to any desired value. Also, by the friction resistance with the cover film one end of which is fixed, the cover film 15 is given an appropriate tension and some or other concavity and convexity caused by the occurrence of creases or the sucking of air are prevented from taking place, so that the film may be positioned in close contact with the peripheral surface of the coating roll. Note that if the friction resistance is too large between the coating roll 11 and the cover film 15, the cover film 15 may deform or be damaged or, due to excessive braking, the rotational energy of the roll may be lost, so that the friction resistance needs to be adjusted to an appropriate value.

Next, the slurry storage 14 for the dispersion slurry will be explained. This slurry storage 14 plays the role of a head bath for storing the dispersion slurry 24 temporarily as it is in a uniform and homogeneous state causing no concentration distribution nor coagulation as a preparatory step for obtaining a uniform coating condition both in the width and the length direction. Generally speaking, in this slurry storage 14 an agitator may be needed for preventing the concentration distribution possibly caused by the solid particles coagulating or settling down from taking place and for securing the uniformity in the width direction. If a slurry supplying apparatus used meets the conditions, the slurry storage may be omitted.

In a coater for a dispersion slurry according to the present invention as structured as described above, the supplying and coating of the dispersion slurry 24 onto the surface of the substrate 12 is performed not in the clearance between the coating roll and the surface of the substrate, as in the case of a conventional roll coating, but between the cover film 15 and the substrate 12. The coating roll 11 only regulates the position of the cover film 15 to the substrate 12, and does not get in contact with the dispersion slurry 24. Therefore, no problem on the difference of dispersion slurry adheres to the surface of the coating roll is found in the present invention.

Figure 11B:
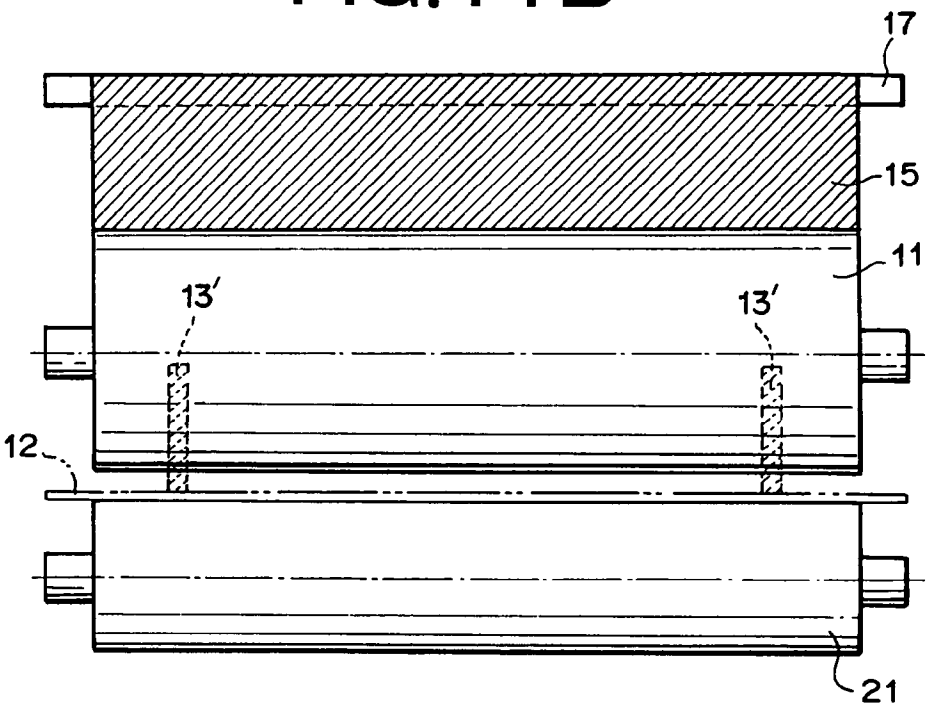
FIGS. 11A~11B show a coater as other embodiment of the present invention with a cover film applied.
Figure 11A:
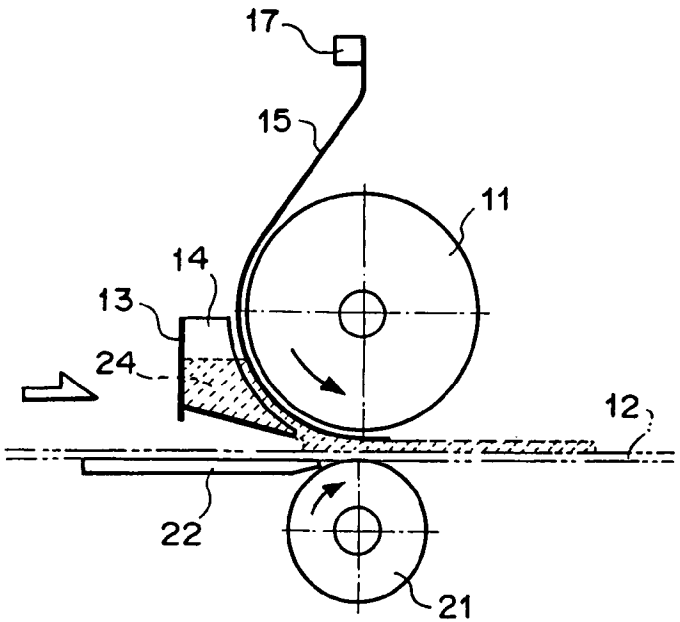

In a coater for a dispersion slurry according to the present invention, it may be sometimes preferable to regulate the range of coating with respect to the width direction of the continuous running substrate just as in a conventional roller coating. FIGS. 11A~11B show a coater according to other embodiment of the present invention, and an example of a coater provided with a side seal portion 13' as a means of regulating the coating width direction; FIG. 11A is a cross sectional view of the coating in roll 11 on the vertical plane of the axis center, and FIG. 11B is its elevation view. In an apparatus shown in FIGS. 11A~11B, a support roll 21 is provided facing a coating roll 11 having the discharge position between them in the vicinity of the bottom end of the coating roll 11, and the substrate 12 is so constituted as to pass between the coating roll 11 and the support roll 21. Also, on the upstream side of the delivery position with respect to the running direction of the substrate 11, a liquid seal portion 22 is provided for the purpose of preventing the leakage of liquid to the downstream of the substrate 12.

The side seal portion of this example shown by a numerical reference 13' comprises a pair on the left and the right side consisting of both side gates of a slurry storage 14, and, in order to prevent leakage of liquid in close contact with the rear end plate portion 13 on the surface of the coating roll 11, is positioned inside of both side portions of the cover film 15 and fixed by a means such as welding and an adhesive to the rear portion plate 13 of the slurry storage 14.

This side seal portion 13' is so provided preferably as to be in contact with the peripheral surface of the coating roll 11 in order to prevent the dispersion slurry 24 from leaking outside through a gap with the peripheral surface of the coating roll 11. In this case, however, the side seal portion 13' preferably has sealability to the peripheral surface of the coating roll 11 and at the same time has lower friction resistance and less wearing. In order for the side seal portion 13' to meet such requirements, it is preferably constituted by a resin material selected from a synthetic rubber, a foamed material, Teflon (registered trademark) and the like.

The dispersion slurry supplied to the slurry storage 14 is sealed by the rear end plate portion 13 on the rear portion and by the side seal portion 13' on both sides and passes through the only exit formed between the slurry storage 14 and the cover film 15 to be used for coating the continuously running substrate 12.

Figure 12B:
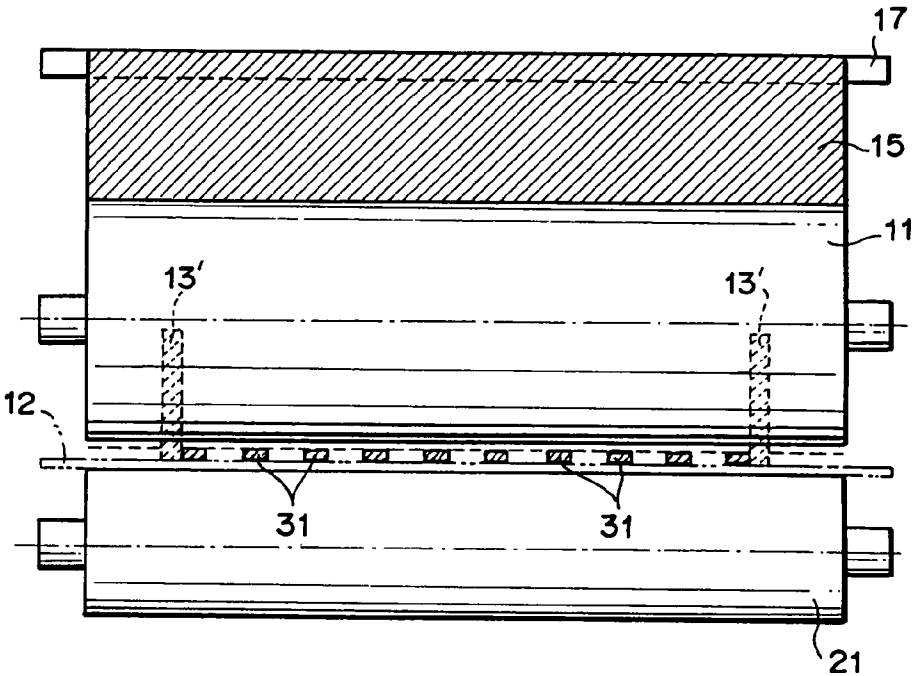
FIGS. 12A~12B show a coater as a still other embodiment of the present invention with a cover film applied.
Figure 12A:
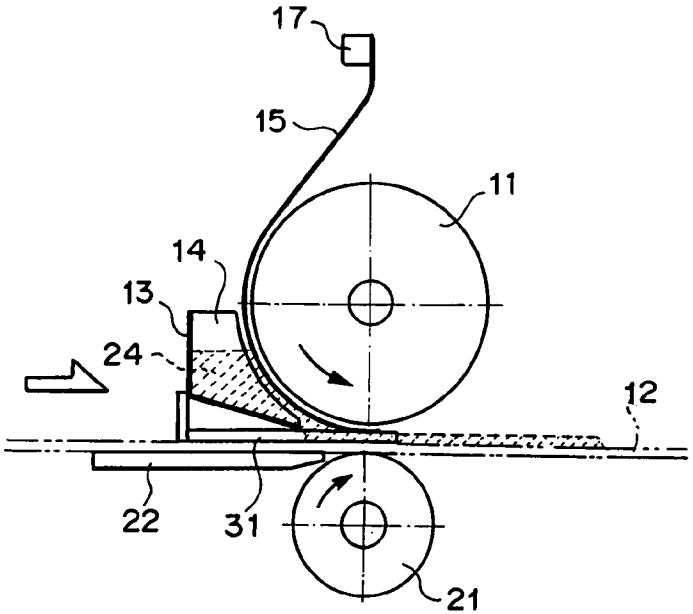

In addition, FIGS. 12A~12B show a coater according to still other embodiment of the present invention. This coater is so constituted as to coat a substrate with a dispersion slurry in a pattern of lines; at least one pattern spacer 31 is disposed as extending in forward direction of the substrate 24 between the exit of the dispersion slurry from the slurry storage 14 and the surface of the substrate 12 running continuously under the exit. This pattern spacer 31 is to segment the flow of the disperse slurry 24 being supplied uniformly in the whole area between the side seal portions 13' on both sides at the positions of the pattern spacers 31 thereby making the coating pattern of the dispersion slurry 24 to be coated onto the surface of the substrate 12 into multiple lines. The number of lines in the pattern is determined by the number of the pattern spacers 31 installed; as shown in FIG. 12B, when 10 sets of the pattern spacers 31 are installed, a line pattern consisting of 9 lines is formed.

Hereunder, a cover film 15 used in a coater for a dispersion slurry according to the present invention is discussed.

First of all, the principal functions of the cover film 15 are as follows:

(1) The cover film 15 covers the area of the coating roll 11 which is in contact with the dispersion slurry 24 so that the dispersion slurry is prevented from getting into contact with the surface of the roll and from adhering on the surface of the roll.

(2) One end of the cover film 15 being fixed and the other end being free to move, by the action of edge effects provided by the free end portion, the dispersion slurry may easily be withdrawn from the surface of the cover film 15.

Out of the above-described functions, the one given in (2), i.e. the function provided by the free end of the cover film 15, is particularly important, which function will be explained in detail below:

<Developing of Effects of Sharp Edges at Rear End Portion>

The dispersion slurry which has partly deposited on the surface of the substrate 12 and is so in contact with the cover film 15 is separated from the cover film at the free end, and then is transferred onto the substrate 12 to complete the coating operation. On the transferring of the dispersion slurry at the end of the cover film, i.e. if the parting of the dispersion slurry parting from the edge of the cover film, is not smoothly done, the dispersion slurry may attach at the end portion of the cover film and may further deposit at the exposed surface of the coating roll 11 not covered by the cover film 15 causing lumps to be formed with the unfavorable result that the coated surface may become rough and since the surface is not uniformly coated. Furthermore, if this condition continues as it is, the dispersion slurry may be cause clogging, so that no continuous coating can be performed. Also, such condition may cause waves of concaves and convexes in the width direction which in turn causes non-uniformity in thickness in the width direction.

Thus, the cover film 15 is required to have an appropriate rigidity and at the same time its edge needs to be sharp. The reason therefore is that the edge of the cover film 15 needs to serve just like a sharp edge provided by a comma coater or an edge coater. What affects such function which is expected from the cover film are the material of the cover film and its thickness. The desirable materials as the cover film 15 are typically polyester, oriented polypropylene, Teflon (registered trademark), LDPE, polyvinyl chloride and the like.

In addition, the cover film 15 may be constituted by one sheet of film of either of the above-mentioned materials, and also may be made by laminating 2 sheets of film of the same material. Also, 2 sheets of film of different materials may be used. For example, in case PET film is used, it is preferable that a first film is a PET film having a thickness of 50 μm or more and a second film is a PET film having a thickness of 50 μm or less. Also, combinations of 30 μm film and 100 μm film, of PET film/Teflon (registered trademark) film, and of PP film/metal foil are available.

Among them, a particularly preferable material is a polyester film, e.g. Lumilar (registered trademark, Toray Co., Ltd.) or its surface treated product.

The thickness of a film constituting the cover film depends upon the rigidity of the material, and if the film is too thin, its rigidity may be less than desired, it is apt to bend and deform. An appropriate thickness is 30 μm or more. Conversely, if the thickness is too thick, the film may not well match the coating roll 11. The thickness should be 300 μm or less. The thickness is preferably approximately 40~200 μm. The preferable thickness also applies to a cover film consisting of two laminated sheets of film, depending upon the materials used.

The surfaces of the cover film 15 may be both smooth, and its roughness may also be treated it may be treated with a detaching agent such as Teflon (registered trademark) in order to lower the friction resistance on the surface in contact with the coating roll 11. Also, the dispersion slurry 24 may likely adhere by the action of electric adsorption on the surface of the cover film in contact with the dispersion slurry, so the surface of the cover film 15 in contact with the dispersion slurry is desired to be given an electrostatic or a metal vaporizing treatment.

<Positions of Free End of the Cover Film and Controlling of Such Positions>

Figure 13A:
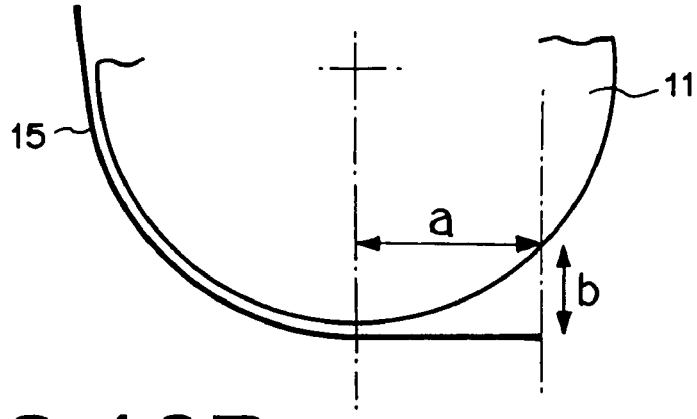
FIGS. 13A~13C show illustratively the position of the bottom end of a coating roll and different positional relations of the free end of a cover film extending to the downstream from the position of the bottom end of the coating roll with respect to the running direction of a substrate.

The relation between the position of the bottom end of the coating roll 11 and the free end of the cover film 15 extending downstream with respect to the running direction of the substrate 12 affects the staining of the coating roll 11 or the easiness of dispersion slurry to separate from the edge of the cover film 15, so it is one of the very important elements. FIG. 13A shows an example where no pattern spacer is provided underneath of the coating roll 11 and coating is done on the whole area of the substrate 12, and in this case the position of the cover film 15 is regulated by a distance a from a point dropping vertically from the axis center of the coating roll 11, i.e. the bottom end of the coating roll 11, extending to the downstream side with respect to the running direction of the substrate 12 and a distance b coming down vertically between the front end of the cover film 15 and the peripheral surface of the coating roll 11.

Figure 13B:
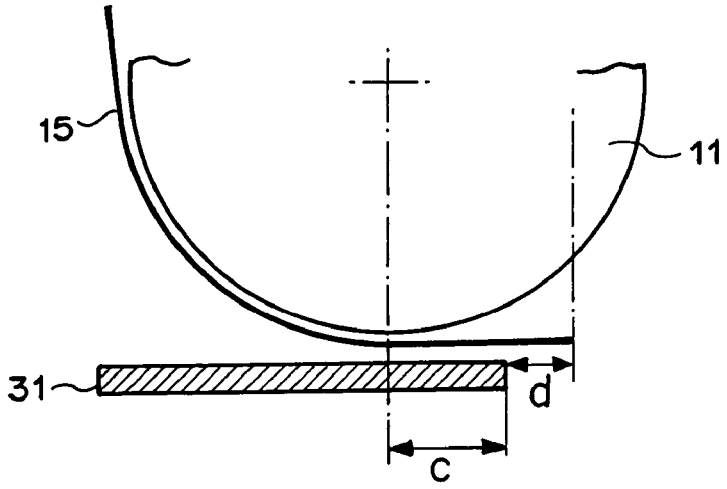
Figure 13C:
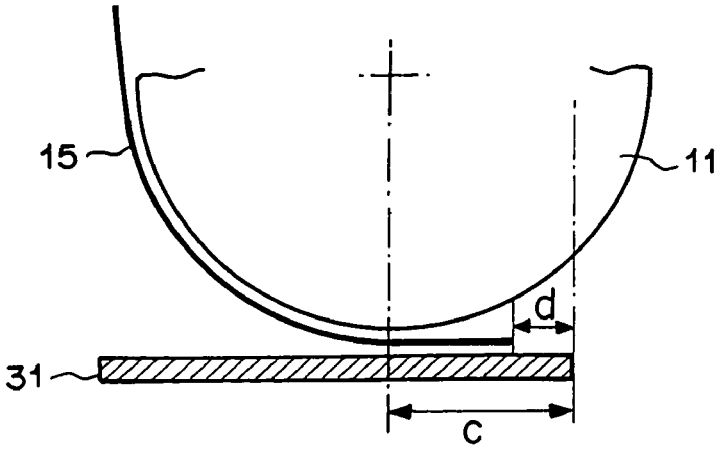

In case a pattern spacer 31 is provided for forming a pattern, in addition to the above-mentioned distances a and b, as shown in FIGS. 13B and 13C, a distance c, which is between the bottom end of the coating roll 11 and the front end of the pattern spacer 31, and a distance d, which is between the front end of the pattern spacer 31 and the front end of the cover film 15, are required to be taken into consideration.

Note that FIG. 13B shows a case where the front end of the cover film 15 extends further downstream beyond the pattern spacer 31 and FIG. 13C shows a case where the front end of the pattern spacer 31 extends further downstream beyond the cover film 15.

A distance 'a' from the bottom end of the coating roll 11 to the front end of the cover film 15 is desired to be more than 1 and preferably 3~30 mm, and more preferably 5~25 mm. If the distance is shorter than 3 mm, the edge effect is not sufficiently exhibited, and the disperse slurry may likely adhere onto the front end of the cover film 15 and to the peripheral surface of the coating roll 11 which is getting near to the front end of the cover film 15. Conversely, if the distance is longer than 30 mm, the dispersion slurry may adhere in solid form onto the surface of the cover film 15, and the coated surface may likely be non-uniform. On one hand, 'b' value, a distance in a vertical direction between the front end of the cover film 15 and the peripheral surface of the coating roll 11 is preferably long as much as possible in principle, but its appropriate value is approximately 1~10 mm.

Distances c and d are selected appropriately depending upon the substrate 12 to be coated and the required coating patterns. Several examples of such distances are given in FIGS. 14A~14C. Note that in these examples as solid particles a super absorbent resin having an average particle diameter of 300 μm (Aqua Pearl AP 211 (trademark), Sun Dia Polymers) and as a dispersing medium $EtOH/H_2O$=65/35(parts/parts) are used, and a dispersion slurry was prepared by dispersing 20 parts of the super absorbent resin and 2 parts of cellulose powder into 100 parts of the dispersing medium, and coating was performed on 50 g/m$^2$ of a PE/PET fiber based thermally bonded nonwoven fabric substrate.

Hereunder, principal conditions for coating a substrate with a dispersion slurry according to the present invention using a coater according to the present invention are explained:

First of all, the dispersion slurry is prepared by dispersing a super absorbent polymer (SAP) in a dispersing medium. Said SAP swells very much in water, but its swelling is controlled by adding an organic solvent such as methanol, ethanol, isopropyl alcohol, and propylene glycol, all being miscible with water, so the disperse slurry may be adjusted. To this system, as a viscosity adjusting agent or a coagulation inhibitor ethyl cellulose, PEO, or MFC may be added. Said SAP may be in such forms as fibrous, solid particulate, particulate or flaky form, but in making a slurry of such SAP, its forms are preferably particulate, powder or flake. A preferable form of SAP is a powdery form having an average particle diameter of 1000 μm or less, more preferably it has an average particle diameter of 100 μm or less.

As a substrate to be coated with this dispersion slurry, tissue, a generally used nonwoven fabric, a woven fabric and the like may be used. A preferable substrate is a bulky and porous substrate such as a bulky nonwoven fabric and a corrugated knitted fabric in which SAP particles can be contained in their network.

Next, a specific example is explained of coating a substrate with the above-described dispersion slurry using a coater for a dispersion slurry according to the present invention as shown in FIGS. 12A~12B.

Figure 14A:
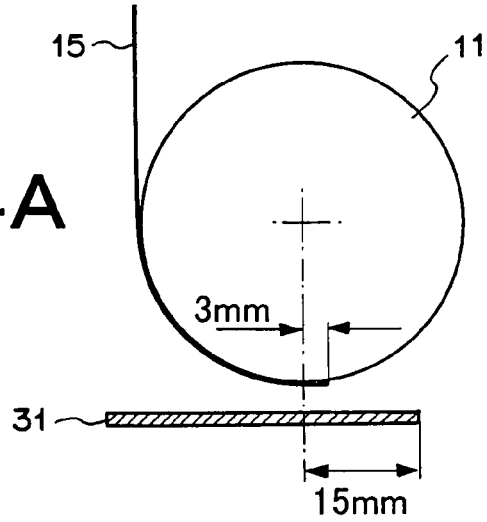
FIGS. 14A~14C show illustratively the relation among a coating roll, a cover film and a pattern spacer in a coater according to the present invention.

In FIGS. 12A~12B, the dispersion slurry 24 is supplied to the slurry storage 14 at a uniform flow rate with respect to the axis direction of the coating roll 11 and while being preferably slowly in order to prevent the dispersion slurry from depositing, is applied for coating the surface of the substrate 12. In this example, the conditions shown in FIG. 14A are employed in the coater.

Coating was performed using a coater of this configuration, and in a pattern of lines at intervals of 10 mm, a SAP coated substrate whose basis weight was 200 g/m$^2$ was obtained. Note that, although in the course of coating there was no problem observed during the first several minutes, gradually later there was a tendency seen for lumps to be formed as the dispersion slurry adheres to the front end of the cover film and to the coating roll portion in close contact with the cover film, but as the speed was increased to 30 m/min, such lumps became smaller and less often happened.

Figure 14B:
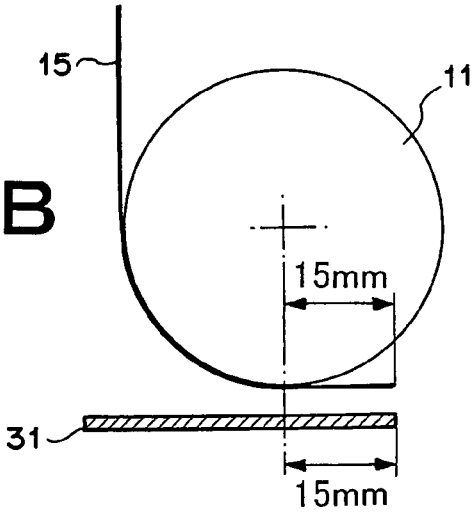

Similarly, in the condition shown in FIG. 14B, no lumps were formed even at a speed of 10 m/min, and thus stable coating for a long period of time was achieved. Even though the speed was increased to 30 m/min, no large changes were observed. Little or no adhesion of the dispersion slurry to the surface of the coating roll was observed.

Figure 14C:
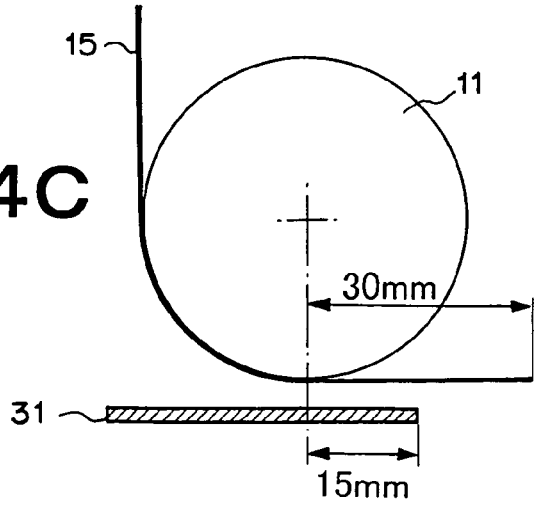

Furthermore, in the condition shown in FIG. 14C, neither adhesion to the surface of the coating roll nor formation of lumps were observed either at speeds of 10 m/min and of 30 m/min. At the speed of 10 m/min, however, as the time passed, some solidified adhered substance of the dispersion slurry was found between the front end surface of the pattern spacer and the cover film, and the bottom surface of the cover film was gradually stained. Such adhered substance became less at a speed of 30 m/min.

Note that, in FIGS. 13A~13B and in FIGS. 14A~14B, for the convenience of drawing these figures, dimensions a, b, c and d are shown enlarged compared with their actual dimensions. Specifically, the lengths a, b, c and d are shown longer against the diameter of the coating roll.

Figure 15A:
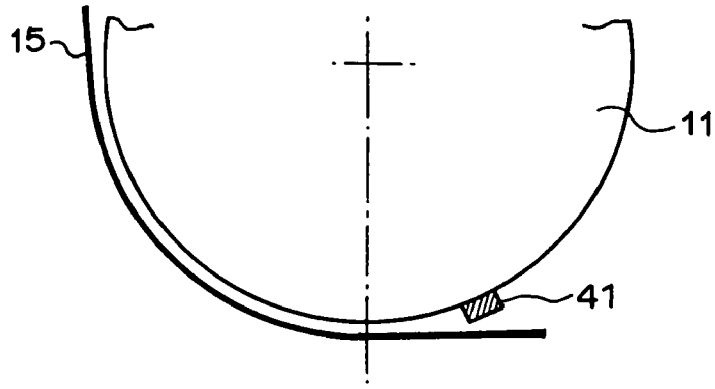
FIGS. 15A~15C show illustratively specific examples of means for holding a desired distance between a coater and the free end of a cover film.
Figure 15B:
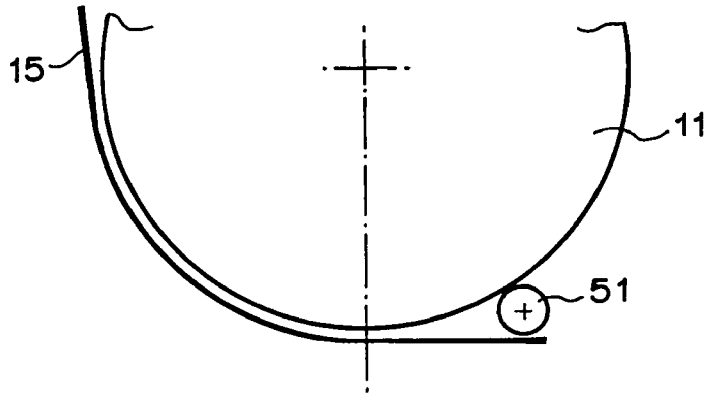
Figure 15C:
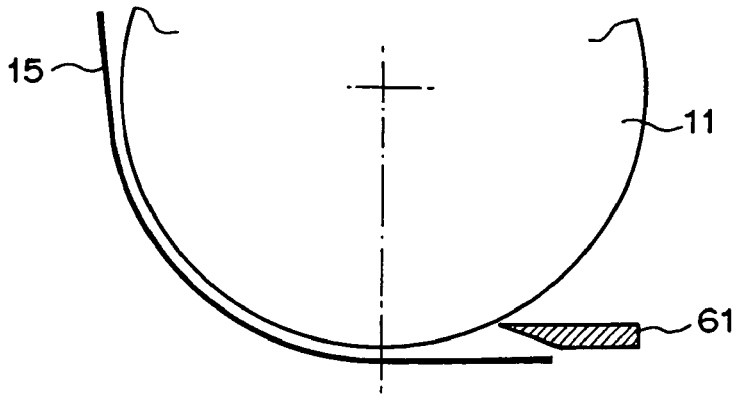

FIGS. 15A~15C show a specific example of a schemes for maintaining a distance b between the coating roll 11 and the free end of the cover film 15 at a desired value. This distance b is maintained preferably at approximately 1~10 mm for the above-described reasons, and for that purpose a separator unit is provided preferably at the exit area of the coating roll 11 for regulating the distance between the coating roll 11 and the free end of the cover film 15. FIG. 15A shows an example of a bar plate 41 being provided as fixed to the coating roll 11, and by approximately changing the height of this bar plate 41 the distance between the coating roll 11 and the cover film 15 could be freely set as desired. This bar plate 41, however, can only be employed in a case where the coating roll 11 is not rotating.

FIG. 15B shows an example where a small diameter, e.g. an approximately 10 mm diameter, rotating roll 51 is provided between the coating roll 11 and the cover film 15 in parallel to the axis center of the coating roll 11 and with the peripheral surfaces being made near to each other or in contact with each other. The rotating roll 51 may be left stationary while the coating roll 11 is left at a standstill, or only the rotating roll 51 rotates when there is no contact and while the coating roll 11 is rotating, the rotating roller 51 may be made to synchronously rotate while in contact with the coating roll 11. The rotating roller 51 is preferably covered with such material as silicone rubber in order to increase its surface smoothness. By the existence of this rotating roller 51, the vertical distance b can be secured.

In addition, an example shown in FIG. 15C can be applied to the case where the coating roll 11 is made to rotate at all times, and a scraper 61 of a knife edge type is provided which is near to the peripheral surface of the coating roll 11, in which case even if the cover film 15 moves nearer to the coating roll 11, the contact between both of them can be prevented by the scraper 61, so that the cover film 15 may not get into contact with the coating roll 11 and thus the vertical distance b is secured.

In case the coating roll 11 is so constituted that it rotates continuously in one direction with its axis center as the center, a relative difference in speeds between the running speed of the substrate and the peripheral speed of the coating roll is expressed with a case where such difference is in a range of −10%~+10% as a constant speed. The relation between the running speed of the substrate and the rotational speed of the coating roll depends upon such factors as the thickness of the film, the running speed and the desired basis weight; when the rotational speed of the roll is zero, i.e. the roll is at a standstill, the film not being given any tension gets slackened so some or other scheme is required to give tension to the film and thus making the equipment more complicated. It is preferable to make the roll to rotate thereby allowing the film in close contact with the roll and its end portion is to be stable.

The rate of rotation depends upon the running speed, so it is difficult to regulate the range of the rates of rotation. A normal running operation is to change the running speed of the substrate appropriately at a constant rotational speed and a constant tension given to the film. Tables 3 and 4 show examples of setting such conditions.

Table 3 shows the relation of the running speed to the rotational speed of the roll at the running speed of 50 m/min. The running operation gets stabilized if the running speed is beyond approximately 5 m/min (10%). If a zone of 90% or higher and 110% or lower of approximately the equal speed as the speed of the substrate is made to be the equal speed zone, a zone of 10% or higher and 90% or lower is called a low speed zone and a zone of 110% or higher and 30% or lower is called an high speed zone.

The roll rotates always via the film, so what are being affected by the rotation of the roll are the contact of the film and a delicate change in the front end of the film. If the speed is higher than 75 m/min (150%), the tension gets high and at the same time sometimes the front end of the film may vibrate. If such vibration gets intense, the coating may get disturbed, but lumps may be prevented from developing and growing. Such vibration effect is highlighted by providing shallow grids on the surface of the coating roll.

In case the running speed of the substrate is changed over a wide range, as shown in Table 4, it becomes possible to make the substrate run independently of the speed of the coating roll by fixing the rotational speed of the coating roll at around 30 m/min and optimizing the material and the thickness of the film to such speed.

TABLE 3

Examples of setting of conditions of coating roll and their results (1)

| Running speed of substrate (Pm/min) | Rotational speed of coating roll (Q m/min) | Relative ratio ((Q/P) × 100) | State of film being lackened | Stabilized coated amount |
|---|---|---|---|---|
| 50 | 0 | 0 (standstill) | Slackened | Disturbance happening |
| | 3 | 6 (low speed) | Slightly lackened | Disturbance in parts |

TABLE 3-continued

Examples of setting of conditions of coating roll and their results (1)

| Running speed of substrate (Pm/min) | Rotational speed of coating roll (Q m/min) | Relative ratio ((Q/P) × 100) | State of film being lackened | Stabilized coated amount |
|---|---|---|---|---|
| | 5 | 10 (low speed) | Stabilized | Stabilized |
| | 20 | 40 (low speed) | Stabilized | Stabilized |
| | 40 | 80 (low speed) | Stabilized | Stabilized |
| | 45~55 | 90~100 (equal speed) | Stabilized | Stabilized |
| | 60 | 120 (high speed) | Stabilized | Stabilized |
| | 75 | 150 (high speed) | Scheme needed to remove tension | Front end of film vibrating |
| | 100 | 200 (high speed) | Scheme needed to remove tension | Front end of film vibrating |
| | 150 | 300 (high speed) | Scheme needed to remove tension | Front end of film vibrating |

TABLE 4

Examples of setting of conditions of coating roll and their results (2)

| Running speed of substrate (Pm/min) | Rotational speed of coating roll (Q m/min) | Relative ratio ((Q/P) × 100) | State of film being slackened | Stabilized coated amount |
|---|---|---|---|---|
| 10 | 30 | 300 (high speed) | Stabilized | Stabilized |
| 20 | | 150 (high speed) | Stabilized | Stabilized |
| 27~33 | | 90~110 (equal speed) | Stabilized | Stabilized |
| 40 | | 75 (low speed) | Stabilized | Stabilized |
| 60 | | 50 (low speed) | Stabilized | Stabilized |
| 75 | | 40 (low speed) | Stabilized | Stabilized |
| 100 | | 30 (low speed) | Stabilized | Stabilized |

⟨Fixing of Cover Film Onto the Coating Roll⟩

The regulation of the position of the cover film 15 to the coating roll 11 is, as shown in FIGS. 10, 11A~11B and 12A~12B, achieved by fixing by means of a fixing device 17 one end of the cover film 15 at a position upward of the coating roll 11 on the upward end and by fixing the cover film 15 to the side seal 13' on both sides.

For fixing the cover film 15 by the side seal 13', in addition to the positional regulation, a function for preventing leakage of the dispersion slurry is also needed, so an appropriate fixing means is desired preferably depending on some conditions such as whether the coating roll 11 rotates or not, the thickness of the cover film 15, etc.

Figure 16A:
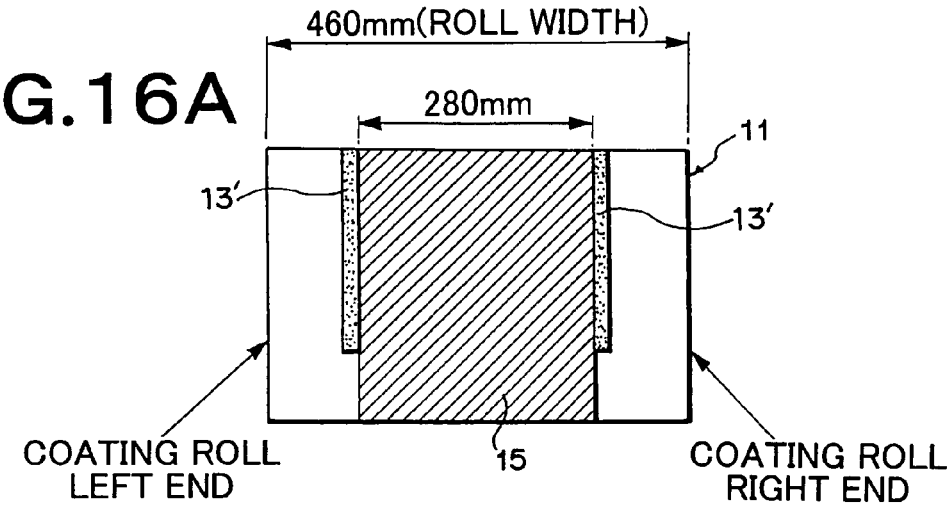
FIGS. 16A~16C show illustratively different covering ranges of multilayers of cover film as applied in a coater according to the present invention.
Figure 16B:
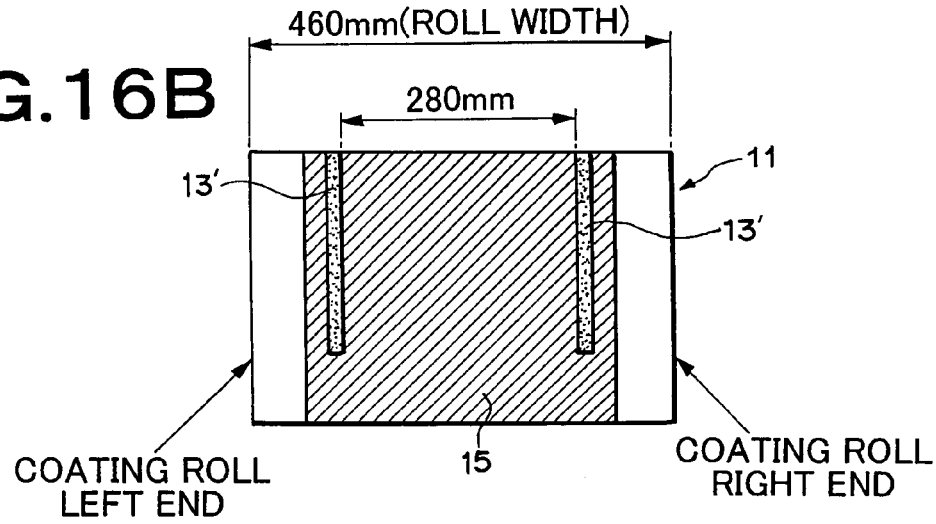
Figure 16C:
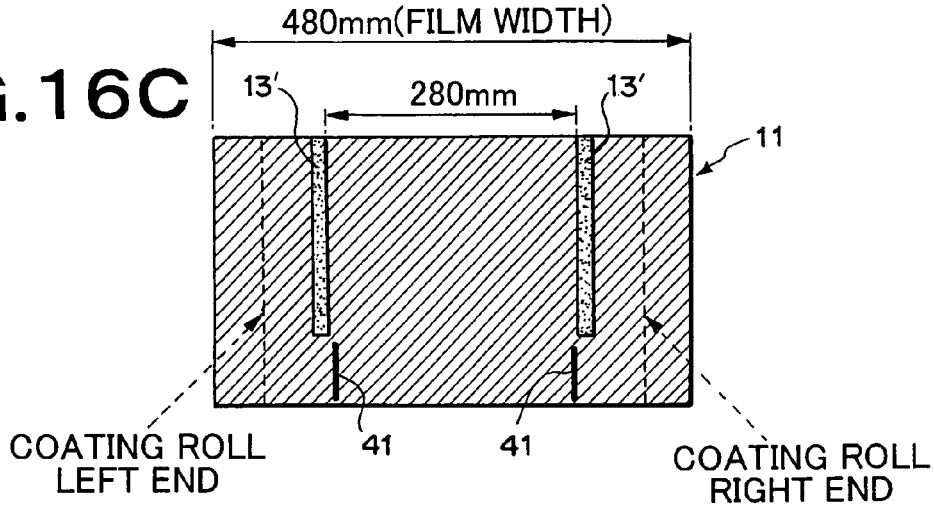

FIGS. 16A~16C show the relation of the width of the coating roll 11 to the width of the cover film 15. An example of a test roll of 460 mm roll width and 280 mm side seal width will be explained below.

FIG. 16A shows a case where the cover film 15 exists only inside of the side seal 13'; the peripheral surface of the coating roll 11 is exposed at the side seal 13' and its outside. In this configuration, in case coating is applied with the coating roll 11 at standstill, the cover film 15 is fixed only at its inlet portion, so the dispersion slurry may likely enter between the cover film 15 and the coating roll 11, which may cause such serous troubles as staining and clogging. Applying an adhesive or a bonding agent is needed so that no such gap will exist between the cover film 15 and the coating roll 11.

Also, in case the coating roll 11 rotates, the cover film 15 is at all times given a tension, so for a stabilize operation incoming air is prevented by applying a small amount of PEG or the like to the cover film 15 when it is first installed.

An advantage of the method shown in FIG. 16A is that since the film is not fixed by the side roll, the free movement of the end of the cover film 15 is high.

On the other hand, in the case of FIG. 16B, the cover film 15 covers in its width direction the whole of the coating roll 11 only except for its edge portion beyond the side seal 13'. Since the cover film 15 is fixed by the side seal 13', the dispersion slurry does not enter between the coating roll 11 and the cover film 15, so whether the coating roll is at standstill or rotates, stabilized operation can be realized. Since the free movement of the end of the cover film 15, however, becomes lower, the localized concavity and convexity on the surface of the coating roll may cause unevenness in coating as the film get thicker, so some caution needs to be employed against it.

Also, in the case of FIG. 16C, both sides of the cover film 15 covers the whole of the coating roll 11 beyond the side seal 13' and further beyond the ends of the coating roll 11. In this case, too, whether the coating roll is at standstill or rotates, stabilized operation can be realized with no dispersion slurry adhering to the coating roll 11. The free movement of the cover film 15 is lowered because it is tightly fixed. If higher free movement is desired, a slit 71 is provided at a position of the cover film 15 extending from its end to the side seal 13', as shown in FIG. 16C, so that higher free movement may be obtained.

<Multi Layered Cover Film>

As explained previously, the cover film may be of a single layer or of two laminated sheets of film. This multi layered cover film may be not only of two sheets of film wholly bonded together, but also of a combination of a longitudinally long film with a longitudinally short film, or a combination of a laterally wide film with a laterally narrow film.

Figure 17A:
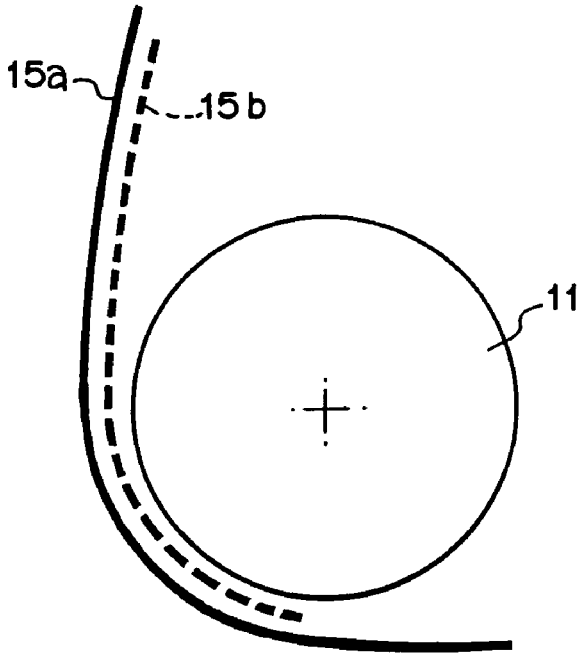
FIGS. 17A~17B show illustratively the relation of mutual lengths in case 2 sheets of film are used.
Figure 17B:
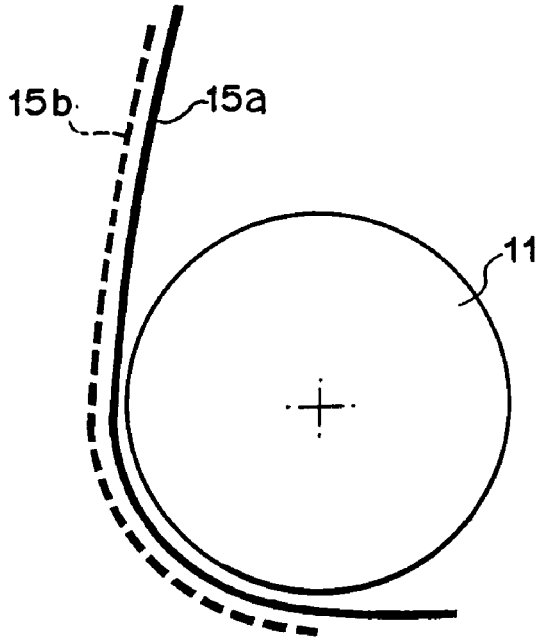

FIGS. 17A~17B show an example where a first film 15*a* and a second film 15*b* are combined in the vertical direction of the axis center of the coating roll (in the longitudinal direction). First, FIG. 17A shows an example where a first relatively thick film 15*a* for a reinforcement purpose is disposed outside facing the coating roll 11, i.e. on the side contacting with the dispersion slurry, and a relatively thin second film 15*b* is disposed on the side of the coating roll 11, and FIG. 17B shows an example where a relatively short second film 15*b* for a reinforcement purpose is disposed outside facing the coating roll 11, i.e. on the side contacting with the dispersion slurry, and a first film 15*a* longer than the second film 15*b* is disposed inside thereof.

Figure 18A:
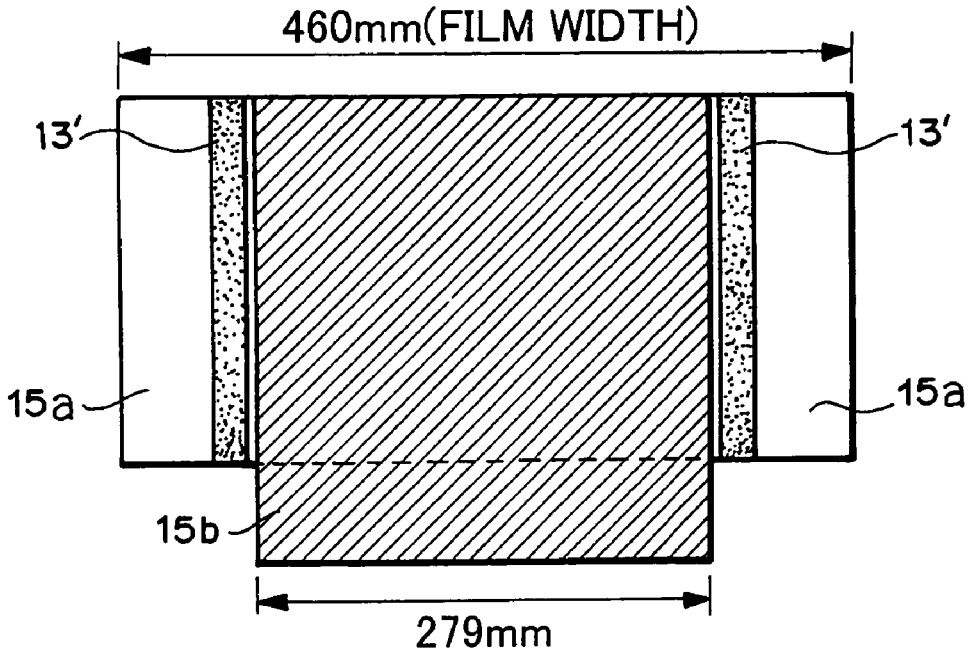
FIGS. 18A~18B show illustratively different covering ranges of multilayers of cover film as applied in a coater according to the present invention.
Figure 18B:
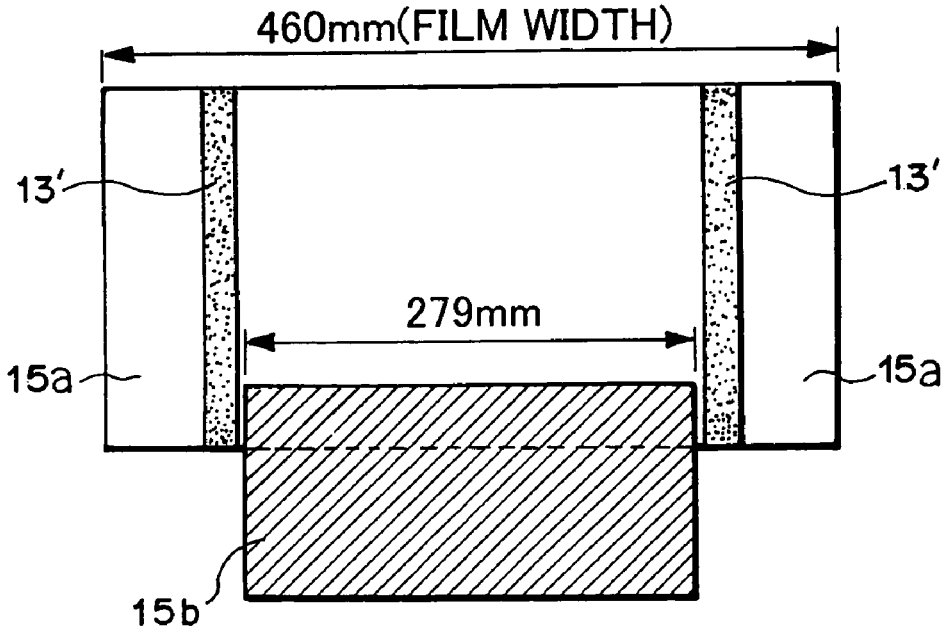

FIGS. 18A~18B show an example where a first film 15*a* wider in width, capable of covering the whole of the coating roll 11 in its axis direction, and a second film 15*b* narrow in width and exist only inside of the side seal 13' are combined. In an example shown in FIG. 18A, a narrow second film 15*b* has a length extending from one end of the region where the cover film is provided reaching the other end of such region and bonded to a first film 15*a* in the portion where the second and the first film are overlapped. The second film 15*b* is of a single layer in the portion where it is not overlapped with the first film 15*a*, and has a large free movement against the coating roll 11. Also, in an example shown in FIG. 18B, a narrow second film 15*b* is bonded to a first film 15*a* in the edge portion where they are slightly overlapped, and so forms an edge portion of high free movement.

In the present invention, no particular restrictions are imposed on the diameter of the coating roll, but generally speaking, the diameter of the coating roll is in a range of 100~500 mm, and in this case, the distance of the edge of the second film extending from the bottom end position of the peripheral surface of the coating roll to the downstream side with respect to the running direction of the substrate is preferably 1~50 mm.

INDUSTRIAL UTILIZATION OF THE INVENTION

As explained above, a coater according to the present invention enables a dispersion slurry to be coated in a uniform thickness in the width and the length direction at a wide range of speeds in the coating of nonwoven fabric substrates over a wide basis weight. Furthermore, in case a cover film is applied, such problem a dispersion slurry adheres to the surface of a coating roll can be solved without any complicated equipment and capital cost increases involved that, as is common to any contact type coater which is in direct contact with a substrate such as a bar coater and a knife edge coater. Therefore, a coater according to the present invention is suitable to the coating of nonwoven fabric substrates.

The invention claimed is:

1. A coater for coating a nonwoven fabric substrate with a dispersion slurry where a solid component is dispersed in a dispersion medium, said coater comprising:

a means for running said nonwoven fabric substrate continuously in a horizontal direction, a coating roll rotating in a positive direction with respect to the running direction of said nonwoven fabric substrate, and a cover film covering the peripheral surface of said coating roll in a range from the vicinity of a top end of said coating roll to the vicinity of a bottom end of said coating roll, a head bath opened at its top portion located above said running nonwoven fabric substrate, said head bath having a vertically adjustable rear gate located on an upstream side of said head bath and forming a bath for storing said dispersion slurry between said rear gate and said cover film on a top surface of said nonwoven fabric substrate, a liquid sealing plate located underneath of said head bath for sealing said head bath so that said dispersion slurry may not leak from a bottom surface of said nonwoven fabric substrate, wherein said dispersion slurry is supplied to a region between a front end of said cover film and the top surface of said nonwoven fabric substrate;

said coating roll is constituted in such a manner that said coating roll adjusts a pressure to said nonwoven fabric substrate and the dispersion slurry applied to the surface of said coating roll to produce a smooth coated surface with said dispersion slurry.

2. A coater according to claim 1, wherein a support roll is provided as disposed at a position facing said nonwoven fabric substrate sandwiched between the support roll and said coating roll disposed vertically and as rotating in a positive direction with respect to the running direction of said nonwoven fabric substrate.

3. A coater according to claim 1, wherein the front end of said cover film is not fixed.

4. A coater according to claim 1, wherein the portion of said cover film other than the front end of said cover film is so fixed by a side seal portion that it is kept at a prescribed position along the peripheral surface of said coating roll at both ends in the axis direction of said coating roll.

5. A coater according to claim 1, wherein a laminated film composed of two films with properties different from each other constitutes said cover film.

6. A coater according to claim 5, wherein a first film out of said two films extends beyond a side seal member and is fixed to said side seal member and a second film with a width to cover only the inside of said side seal.

7. A coater according to claim 6, wherein said first film is disposed facing said coating roll and said second film is disposed outside thereof.

8. A coater according to claim 6, wherein said second film is disposed facing said coating roll and said first film is disposed outside thereof.

9. A coater according to claim 7, wherein said first film is shorter than said second film with respect to the running direction of said nonwoven fabric substrate.

10. A coater according to claim 7, wherein said first and second films are bonded to each other at least in part.

11. A coater according to claim 7, wherein said first film is a PET film having a thickness of 50 μm or more, and said second film is a PET film having a thickness of 50 μm or less.

12. A coater according to claim 1, wherein the front end of said cover film extends at a desired distance from the bottom end of the peripheral surface of said coating roll to a downstream side with respect to the running direction of said nonwoven fabric substrate.

13. A coater according to claim 12, wherein the diameter of said coating roll is in a range of 100~500 mm and the front end of said cover film extends at a distance of 1~50 mm from said bottom end to the downstream side with respect to the running direction of said substrate.

14. A coater according to claim 13, wherein a separator is further provided to prevent the front end of said cover film from getting into contact with the peripheral surface of said coating roll.

15. A coater according to claim 1, wherein a pattern spacer is further provided for forming a coating pattern on the surface of said nonwoven fabric substrate so that said dispersion slurry supplied to the surface of said substrate going from the front end of said cover film to the downstream side with respect to the running direction of said substrate is so regulated not to be supplied to the surface of said substrate.

16. A coater according to claim 1, wherein said coating roll has convex and convex parts on its surface to form a portion where the surface of said coating roll and said cover film are not in contact with each other.

* * * * *